US009322154B2

(12) United States Patent
Beaumont

(10) Patent No.: US 9,322,154 B2
(45) Date of Patent: Apr. 26, 2016

(54) PLUMBING TRAP FLUSHING DEVICE

(75) Inventor: Bart D. Beaumont, San Diego, CA (US)

(73) Assignee: BOEMAR INC., Road Town (VG)

( * ) Notice: Subject to any disclaimer, the term of this patent is extended or adjusted under 35 U.S.C. 154(b) by 793 days.

(21) Appl. No.: 13/983,094

(22) PCT Filed: Jan. 28, 2011

(86) PCT No.: PCT/US2011/023056

§ 371 (c)(1),
(2), (4) Date: Aug. 1, 2013

(87) PCT Pub. No.: WO2011/094636

PCT Pub. Date: Aug. 4, 2011

(65) Prior Publication Data

US 2014/0000019 A1 Jan. 2, 2014

Related U.S. Application Data

(63) Continuation of application No. 12/695,890, filed on Jan. 28, 2010, now abandoned.

(51) Int. Cl.
*E03D 9/00* (2006.01)
*E03C 1/306* (2006.01)

(52) U.S. Cl.
CPC .. *E03C 1/306* (2013.01); *E03D 9/00* (2013.01)

(58) Field of Classification Search
CPC ..... E03C 1/306
USPC ..... 4/255.01–255.12
See application file for complete search history.

(56) References Cited

U.S. PATENT DOCUMENTS

| | | | | | |
|---|---|---|---|---|---|
| 1,331,018 | A | * | 2/1920 | Luthy | 429/143 |
| 2,315,673 | A | * | 4/1943 | Taylor | 4/255.07 |
| 3,526,547 | A | * | 9/1970 | Shock | 134/22.12 |
| 3,535,161 | A | * | 10/1970 | Gutrich | 134/24 |
| 5,222,533 | A | * | 6/1993 | Porter, Jr. | 141/65 |
| 5,253,664 | A | * | 10/1993 | Wilson | 134/167 C |
| 5,497,514 | A | * | 3/1996 | Miller | 4/255.04 |
| 2005/0050624 | A1 | * | 3/2005 | Pangramuyen | 4/255.01 |

FOREIGN PATENT DOCUMENTS

WO 2011094636 A1 8/2011

* cited by examiner

*Primary Examiner* — Lori Baker

(57) ABSTRACT

A plumbing trap flushing device for use in association with one of a drain in a sink, an overflow drain in a basin, a drain in a bathtub, an overflow drain in a bathtub or shower and the like is disclosed. The plumbing trap flushing device includes a connector, a conduit and a nozzle. The connector is releasably and operably attachable to a spout of a tap. The conduit is in flow communication with the connector and has an outside diameter and an inside diameter. The outside diameter is dimensioned to fit into the drain, whereby when the conduit is in the drain air and water freely flows around the conduit into the drain. The nozzle is in flow communication with the distal end of the conduit. The nozzle has a nozzle inside diameter less than the inside diameter of the conduit whereby the water exits the nozzle in a stream.

31 Claims, 30 Drawing Sheets

Side View
174
176

3D View
174
176

Side View
176

Top View
176

Side View
178

Top View
178

PLUMBING TRAP FLUSHING DEVICE

CROSS-REFERENCE TO RELATED APPLICATION

This application is a National Phase application claiming the benefit of the international PCT Patent Application No. PCT/US2011/23056 filed on Jan. 28, 2011, in English, which further claims priority to U.S. Utility patent application Ser. No. 12/695,890 filed on Jan. 28, 2010, the entire contents of which are incorporated herein by reference.

FIELD OF THE INVENTION

This invention relates to plumbing trap flushing devices and in particular to plumbing trap flushing devices that are connectable to a spout of a tap or other liquid supply of hot and/or cold water.

BACKGROUND OF THE INVENTION

It is a common problem for traps and drains in a house to get blocked. In the kitchen they will often get blocked with coffee grounds, food and other debris that are washed down the drain when cleaning the dishes and the sink. In the bathroom hair and other debris will often clog the basin. Homeowners often try to unclog the trap by pouring chemicals down the drain. While this may be successful in the short term these chemicals, if effective, will likely over time degrade the integrity of the trap and drain pipes, as well as being harmful to the environment.

Alternatively, a number of gadgets have been suggested that can be used to unclog the trap but they have only limited success. For example there are some devices that are attachable to a tap for delivering pressurized water into the trap. However, typically these devices anticipate dislodging the clog by building up pressure behind the clog and essentially forcing the clog through the drain. In order to operate such a device it is intended that the drain to the trap be sealed around the device so that pressure can build-up and it is the build-up of pressure that forces the clog through the trap. The problem with this approach is that in order to create enough pressure to push the clog through the trap the pressure would likely exceed the allowable pressures for the pipe, the joints and/or the fittings. Thus using such devices over time would likely degrade the pipe. As well, many of these devices have complex nozzles that may be prone to catching on the drains in the traps when being inserted and removed from the traps. Alternatively many of these devices have nozzles that only fit into the top of the trap and thus do not deliver the water directly to the clog.

Accordingly, it would be advantageous to provide a plumbing trap flushing device that is easy to use and does not rely on pressure build-up in the trap.

SUMMARY OF THE INVENTION

The embodiments of present invention relate to a trap flushing device for use in association with one of a drain in a sink, an overflow drain in a basin, a drain in a bath tub, an overflow drain in a bath tub, an overflow drain in a shower and the like. The plumbing trap flushing device includes a connector, a conduit and a nozzle. The connector is releasably and operably attachable to a spout of a tap. The conduit is in flow communication with the connector and has an outside diameter and an inside diameter. The outside diameter is dimensioned to fit into the drain, whereby when the conduit is in the drain liquid and air is capable of freely flowing around the conduit into the drain. The nozzle is in flow communication with the distal end of the conduit. The nozzle has a nozzle inside diameter less than the inside diameter of the conduit whereby the water exits the nozzle in a stream.

The nozzle may have a nozzle outside diameter no greater than the outside diameter of the conduit. The nozzle may include a nozzle adaptor and an interchangeable nozzle connected thereto. The interchangeable nozzle may have a central hole. Alternatively, the interchangeable nozzle may have a central hole and a plurality of side holes. The side holes may be angled and may be adapted to shoot water at an angle sideways and backwardly.

The outside diameter of the conduit may be 0.250 inches and the inside diameter is 0.187 inches. The inside diameter of the nozzle may be 0.125 inches.

A water supply extension may be attachable to the connector of the plumbing trap flushing device at one end thereof. The water supply extension has a connector releasably attachable to the spout at the other end thereof. The outside diameter of the water supply extension may be 0.500 inches and the inside diameter may be 0.375 inches.

The plumbing trap flushing device and the water supply extension may be sold as a kit. The kit may further include a drain flushing device having a conduit, a nozzle and a connector. The kit may also include a toilet flushing device having a conduit, a nozzle and a connector.

The outside diameter of the conduit of the drain flushing device may be 0.375 inches and the inside diameter is 0.250 inches. The inside diameter of the nozzle of the drain flushing device may be 0.155 inches. The drain flushing device may be adapted to hook onto a drain strainer.

The outside diameter of the conduit of the toilet flushing device may be 0.375 inches and the inside diameter is 0.250 inches. The outside diameter of the conduit of the toilet flushing device may be 0.438 inches and the inside diameter may be 0.375 inches. The inside diameter of nozzle the toilet flushing device is 0.155 inches.

The plumbing trap flushing device may be used for cleaning a toilet.

The conduit of the plumbing trap flushing device may be between 12 and 36 inches long inclusive.

The spout of the tap has an inside diameter and the inside diameter of the conduit of the plumbing trap flushing device may be chosen to be less than the inside diameter of the spout and the inside diameter of the nozzle may be chosen to be less than the inside diameter of the conduit.

The spout has an inside diameter and the inside diameter of the water supply extension may be chosen to be equal to or less than the inside diameter of the spout, the inside diameter of the conduit of the plumbing trap flushing device may be chosen to be less than the inside diameter of the water supply extension and the inside diameter of the nozzle may be chosen to be less than the inside diameter of the conduit.

The spout has an inside diameter and the inside diameter of the water supply extension may be chosen to be equal to or less than the inside diameter of the spout, the inside diameter of the conduit of the drain flushing device may be chosen to be less than the inside diameter of the water supply extension and the inside diameter of the nozzle of the drain flushing device may be chosen to be less than the inside diameter of the conduit.

The spout has an inside diameter and the inside diameter of the water supply extension may be chosen to be equal to or less than the inside diameter of the spout, the inside diameter of the conduit of the toilet flushing device may be chosen to be less than the inside diameter of the water supply extension and the inside diameter of the nozzle of the toilet flushing device may be chosen to be less than the inside diameter of the conduit.

The connector of the plumbing trap flushing device may have inside threads adapted to be threaded onto outside threads of the spout.

The connector of the plumbing trap flushing device may be a universal connector. The universal connector may include a connector adaptor and a connector insert. The universal connector may include a connector adaptor and a plurality of connector inserts.

The connector of the plumbing trap flushing device may include a flange portion adapted to be held in place by an aerator connectable to the spout.

The connector may include a conduit portion and flange portion releasably connectable to the conduit portion and the flange portion being adapted to be held in place by an aerator connectable to the spout.

Alternate embodiment of the present invention relate to a plumbing trap flushing assembly for use with one of a drain in a sink, an overflow drain in a basin, a drain in a bathtub, an overflow drain in a bathtub, an overflow drain in a shower and the like. The drain includes a trap. The plumbing trap flushing assembly includes a conduit, an activator and a nozzle. The conduit is in flow communication with a water source. The activator is operably connected to the water source for turning on and off the water source into the conduit. The nozzle is in flow communication with the conduit. The nozzle is positioned in the drain upstream of the trap, the nozzle has a nozzle inside diameter less than the inside diameter of the conduit whereby water from the water source exits the nozzle in a stream and is directed towards the trap.

The activator may be one of a push activator and a lever activator. The activator is positioned proximate to taps.

The plumbing trap flushing assembly may further include a connector between the conduit and the nozzle and the nozzle extends through the side of a pipe connected to the trap.

Further features of the invention will be described or will become apparent in the course of the following detailed description.

BRIEF DESCRIPTION OF THE DRAWINGS

The invention will now be described by way of example only, with reference to the accompanying drawings, in which.

DETAILED DESCRIPTION OF THE INVENTION

Figure 1:
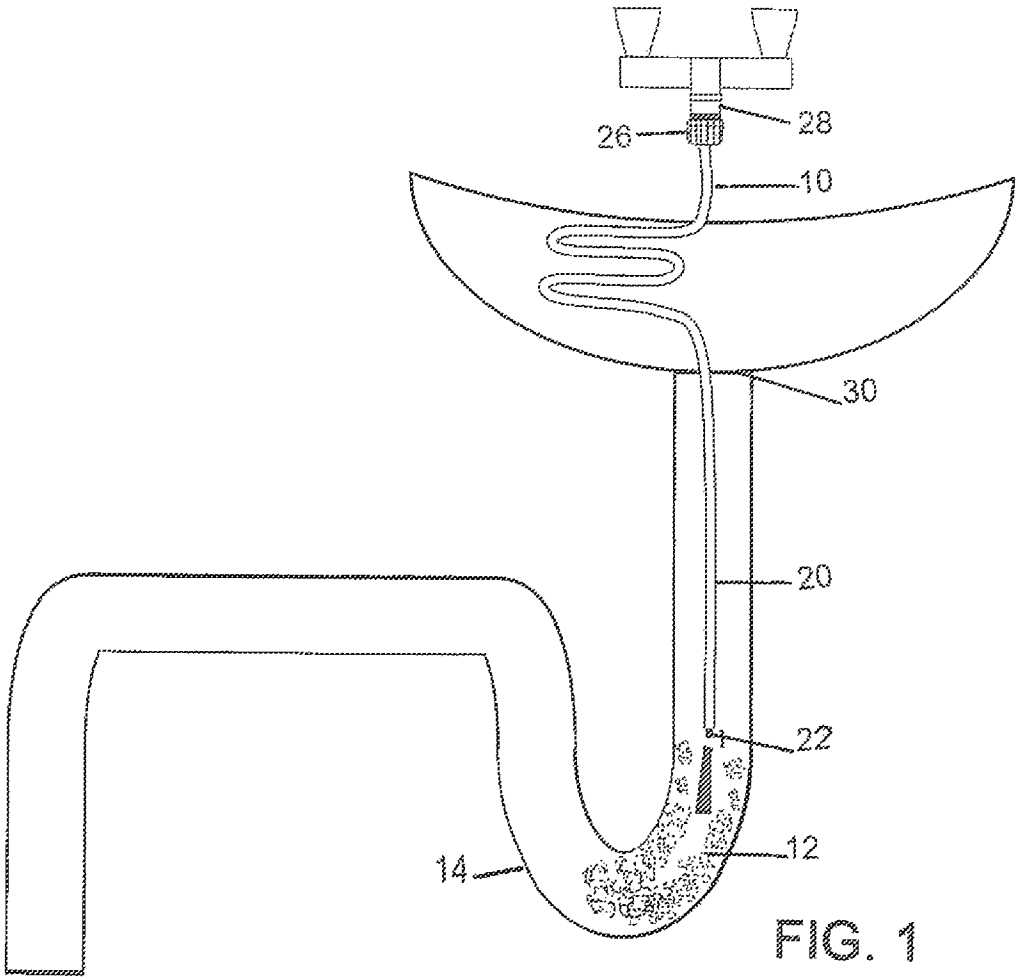
FIG. 1 is a cross-sectional view of the plumbing trap flushing device of the present invention showing a clog at the beginning of the bend of the trap.
Figure 2:
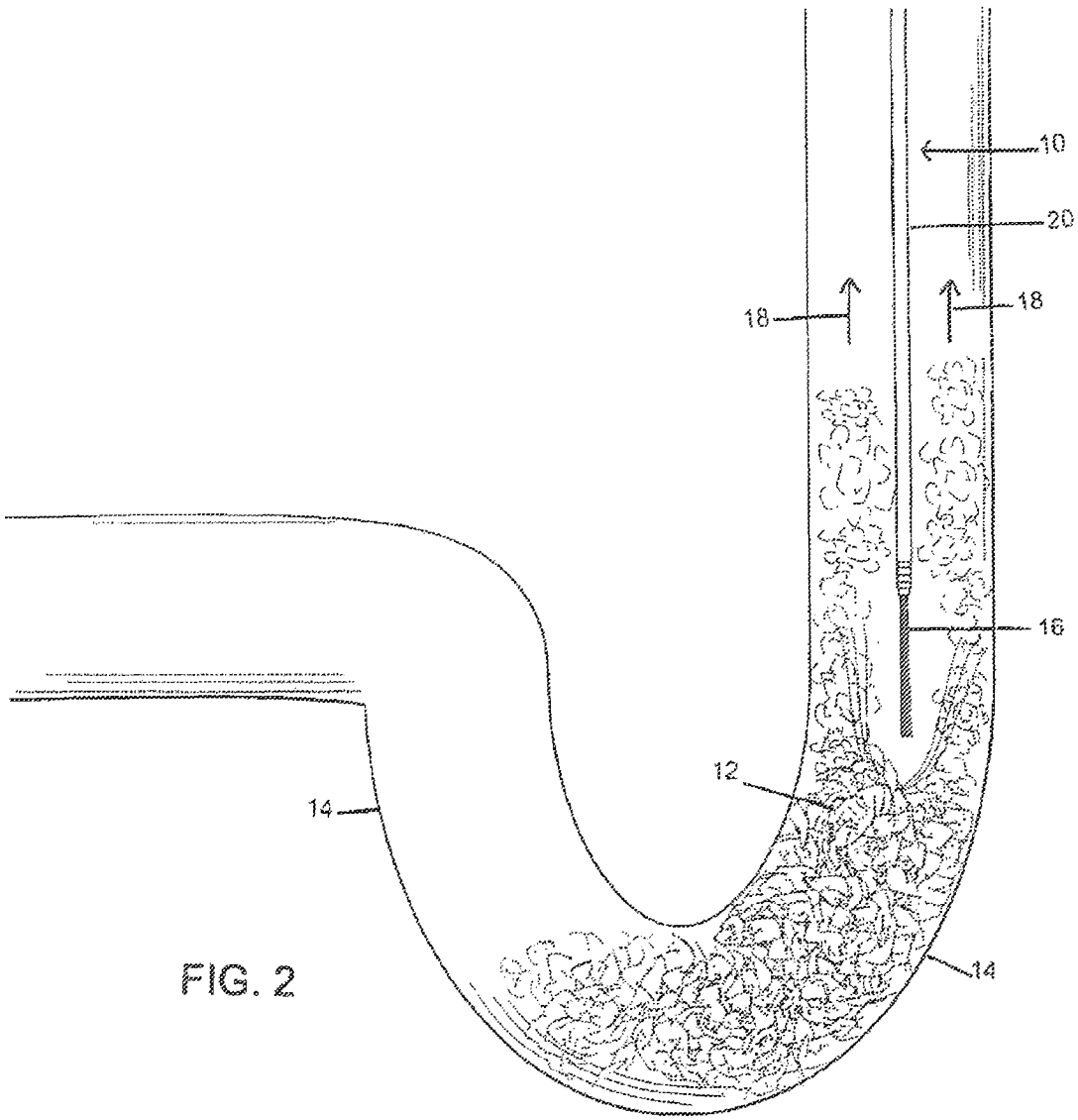
FIG. 2 is an enlarged cross-sectional view similar to that shown in FIG. 1 and showing a portion of the bend of the trap.

FIGS. 1 and 2 show the plumbing trap flushing device 10 of the present invention as it works to dislodge a clog 12 in the trap 14. FIG. 2 is an enlarged view showing a portion of the trap 14 and the water jet 16 from the plumbing trap flushing device 10 beginning to break up the clog 12. The water jet 16 shoots water under pressure into the clog, dislodging some of the clog which moves upwardly as shown by arrows 18.

Figure 3:
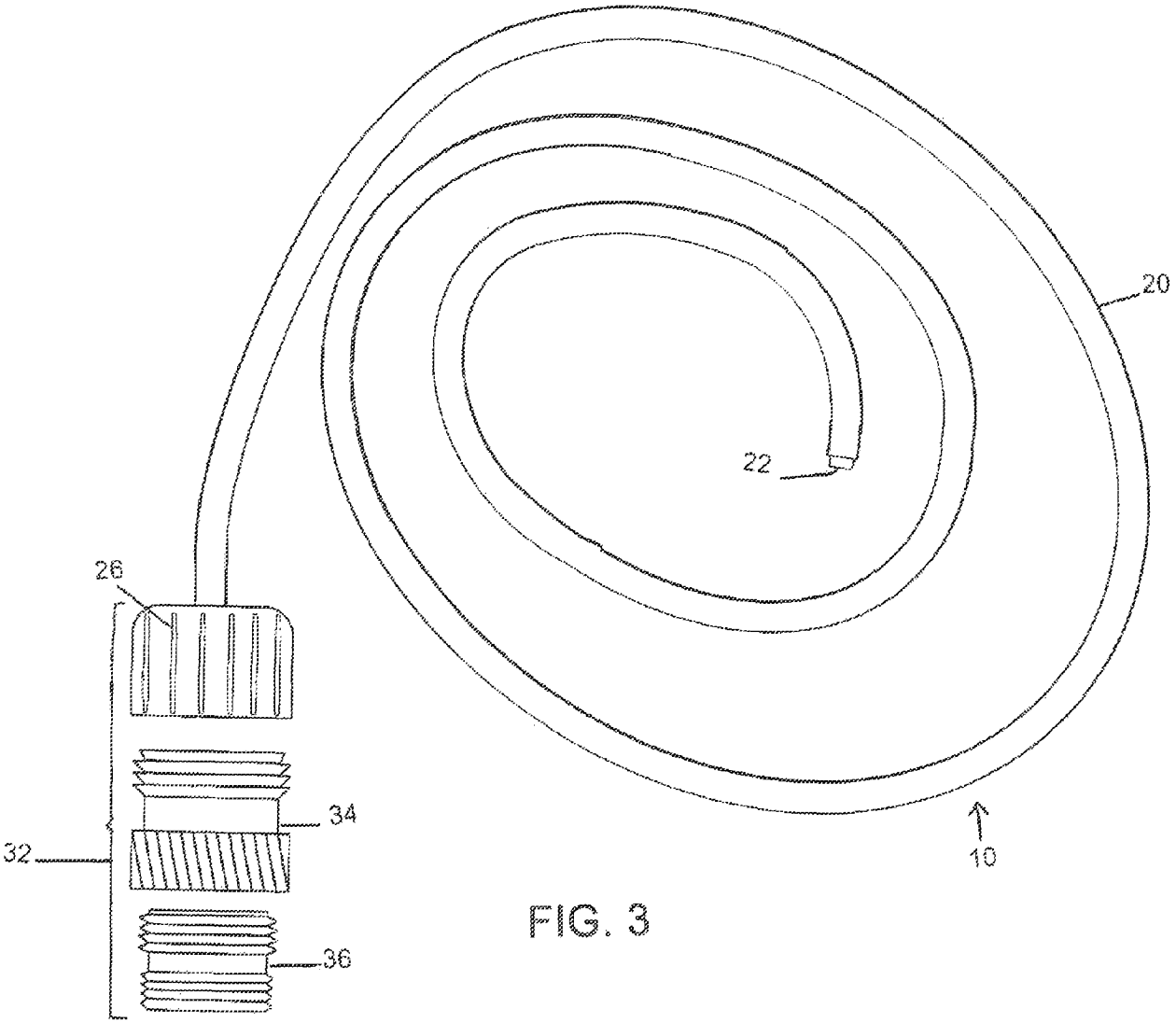
FIG. 3 is an enlarged side view of the plumbing trap flushing device of the present invention.

Referring to FIG. 3, the plumbing trap flushing device 10 includes a flexible conduit 20 having a connector 26 attached thereto, and the connector 26 is releasably connectable to the spout of the tap above the sink. The conduit 20 is insertable into a drain as shown in FIGS. 1 and 2. The conduit 20 is in flow communication with the connector 26. The conduit 20 has an outside diameter and an inside diameter, the outside diameter is dimensioned to fit into the drain. When the conduit 20 is in the drain air and liquid freely flows around the conduit into the drain such that pressure cannot build-up within the pipe. The conduit includes a nozzle end portion 22 for increasing pressure of the liquid in the conduit and producing a water jet at the exit of the nozzle end portion 22. Preferably, the nozzle end portion 22 has an outer diameter that is generally the same as or less than the outer diameter of the conduit. This reduces the changes of the nozzle end portion catching on the drain strainer 30 which is at the mouth of the trap 14.

A connector 26 is attached to conduit 20 at the opposing end of the conduit from the nozzle end portion 22. The connector 26 is adapted to connect the plumbing trap flushing device 10 to a spout 28 of a tap 29 such that the conduit is in flow communication with the connector 26 and, in turn, to the spout 28. The connector 26 has inside threads adapted to be attached to the outside threads on the spout 28.

In use the connector 26 is attached to a spout 28 of a tap 29. The nozzle end portion 22 of the conduit 20 is fed through the drain strainer 30 and into the trap 14. The water is turned on and because of the decreased diameter at the nozzle 22 there is an increased water pressure at the nozzle such that water exits the nozzle in a jet. It is the force from the water jet 16 that works to break up the clog. As the clog is broken up debris from the clog moves upwardly in the trap and may enter the sink or tub. Once a path is created through the clog the water will drain taking the remainder of the debris in the clog and any debris that may have backed up with it.

Figure 4:
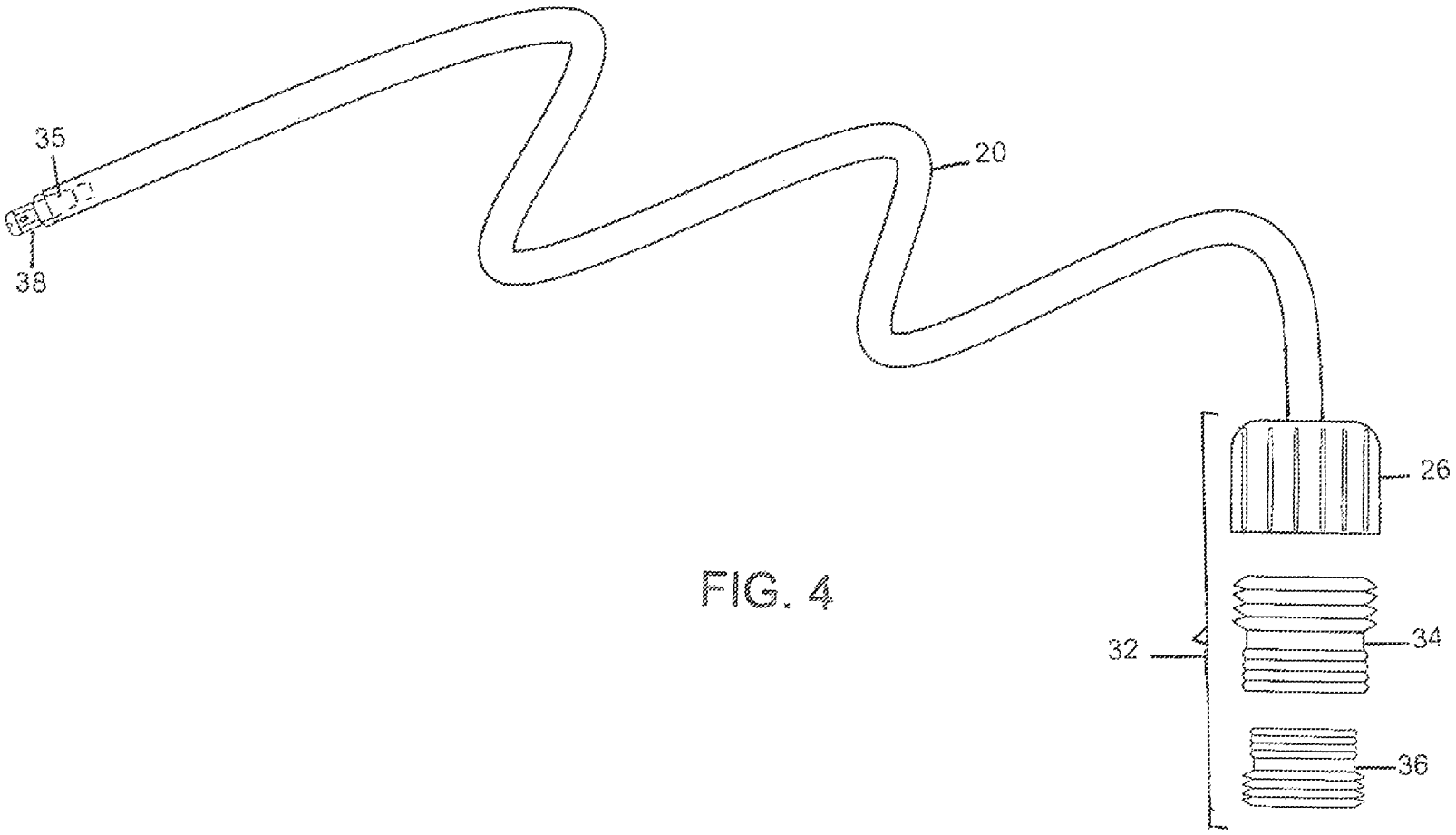
FIG. 4 is an enlarged side view of the plumbing trap flushing device of the present invention similar to that shown in FIG. 3 but showing a different nozzle positioned therein.

There are a number of variations or enhancements that may be used to add to the embodiments described above. Specifically as shown in FIGS. 3 and 4 the connector 26 may be a universal connector 32 which include a connector adaptor 34 and a connector insert 36. As can be seen in FIGS. 3 and 4 the connector adaptor 34 and the connector insert 36 may vary depending on the threads of the spout to which it is being attached. Accordingly, the universal connector 32 allows the plumbing trap flushing device 10 to be connectable to a variety of different sized taps 28. Typically the universal connector would be sold in a kit with multiple connector inserts.

Figure 5:
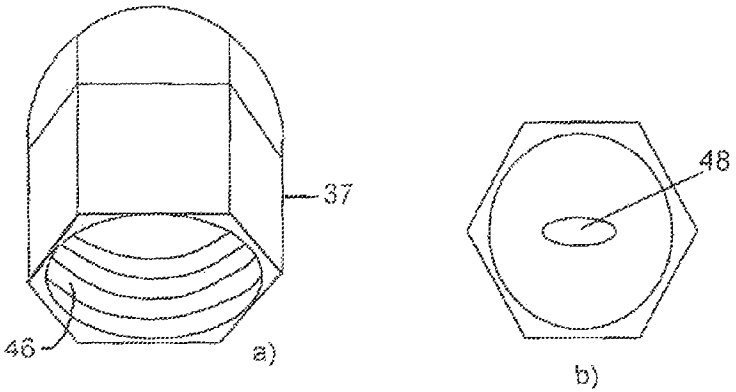
FIG. 5*a*) is a perspective view, b) is a top view and c) is a side view of an embodiment of a nozzle for the plumbing trap flushing device of the present invention.
Figure 6:
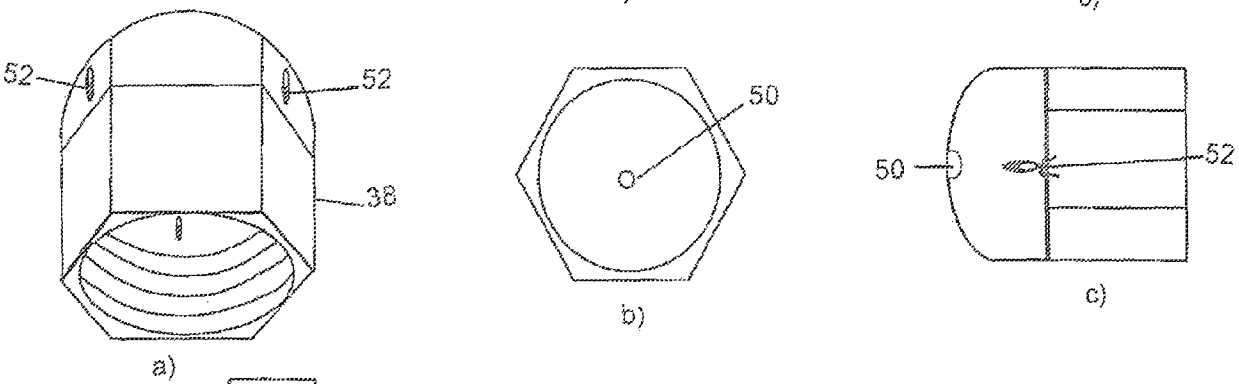
FIG. 6*a*) is a perspective view, b) is a top view and c) is a side view of an alternate embodiment of a nozzle for the plumbing trap flushing device of the present invention.
Figure 7:
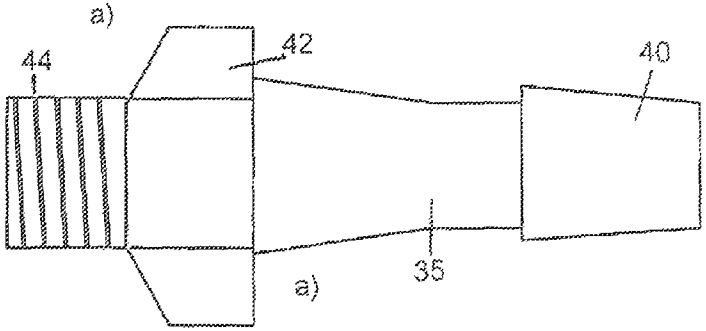
FIG. 7*a*) is a side view and b) is a top view of a nozzle adaptor for use in association with the nozzles of FIGS. 5 and 6.

Nozzle 22 may have a number of different configurations. For example it may be a simple nozzle as shown in FIG. 3 wherein the conduit 20 has an insert that effectively reduces the diameter of the end of the conduit. Alternatively as shown in FIG. 4 the nozzle 38 may be somewhat more elaborate. Some examples of different various nozzles are shown in FIGS. 5 and 6 and a nozzle adaptor is shown in FIG. 7. In use the nozzle adaptor 35 shown in FIG. 7 is inserted into the distal end of conduit 20 as shown in FIG. 4 and a nozzle is then attached to the nozzle adaptor 35. Two examples of interchangeably nozzles that may be attached to the nozzle adaptor 35 are shown at 37 and 38 in FIGS. 5 and 6 respectively. Nozzle adaptor 35 includes an insertion portion 40, a stop portion 42 and a threaded portion 44. The interchangeable nozzles are attached to the threaded portion. As shown in FIG. 7 the insertion portion 40 is inserted in the conduit 20 until it hits the stop portion 42 and then a nozzle is attached to the threaded portion.

Figure 15:
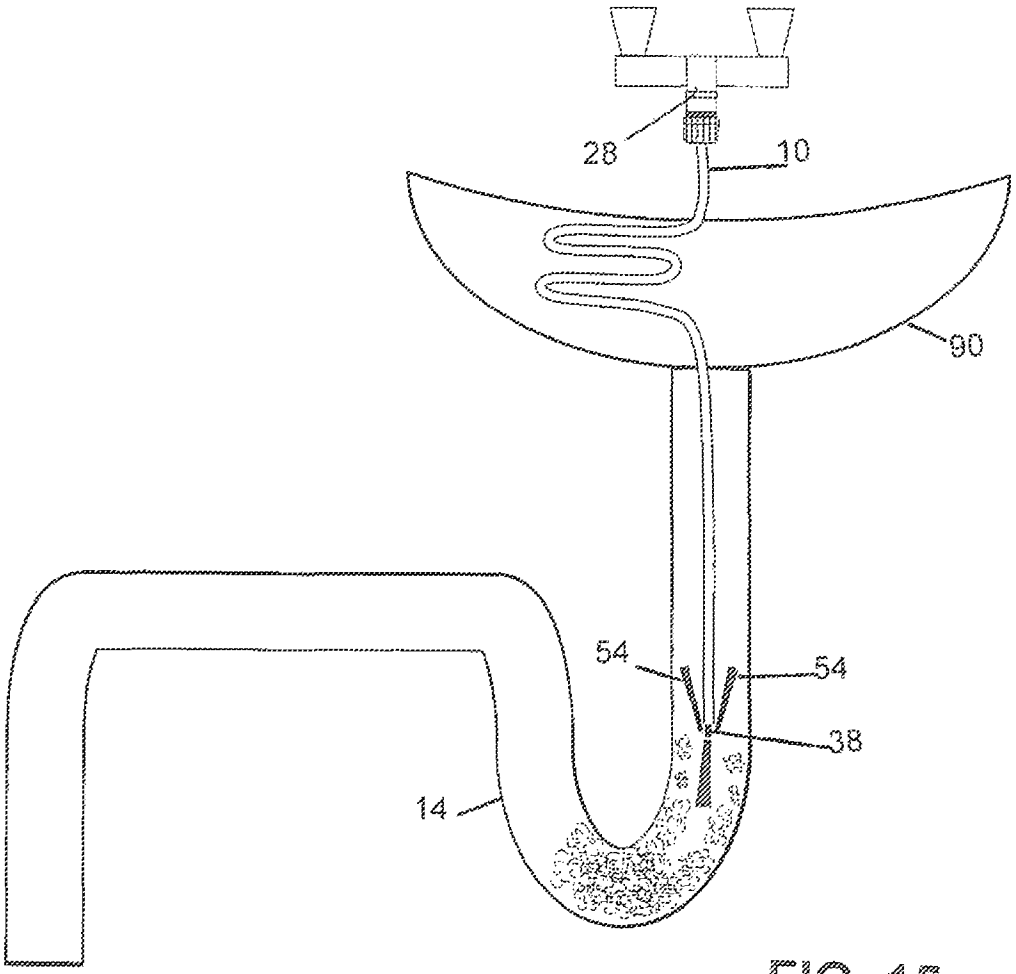
FIG. 15 is a cross-sectional view similar to that shown in FIG. 1 but showing the spray from an alternate nozzle.

Two examples of interchangeable nozzles that are attachable to the nozzle adaptor 35 are shown in FIGS. 5 and 6. Interchangeable nozzle 37 shown in FIG. 5 has an internal thread 46 and a central jet hole 48. In this embodiment the jet hole 48 is oval in shape. Interchangeable nozzle 38 shown in FIG. 6 is similar to nozzle 37 but in addition to a central jet hole 50 it has a plurality of side holes 52. Side holes 52 are shaped so as to produce side jets 54 (as seen in FIG. 15). Preferably side jets are angled backwardly such that the side jets shoot water out at an angle sideways and backwardly. This embodiment has the advantage that the side jets may serve to help pull the plumbing trap flushing device through the trap into the drain. As well the side jets can help to clean the inside of the pipe.

Figure 8:
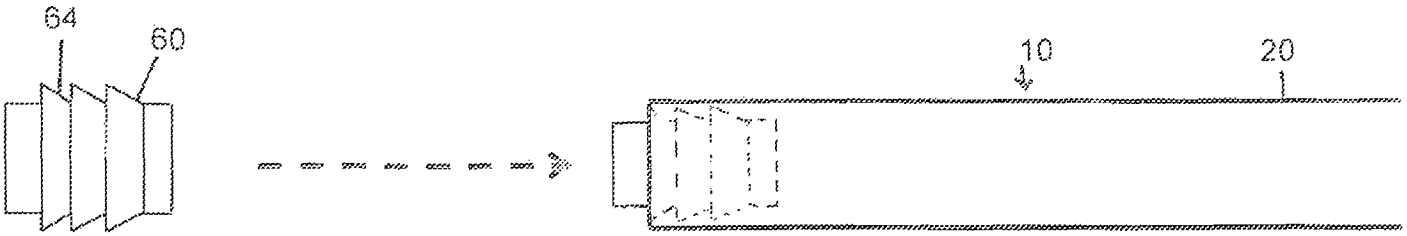
FIG. 8 is an enlarged side view of another embodiment of a nozzle for a plumbing trap flushing device.
Figure 9:
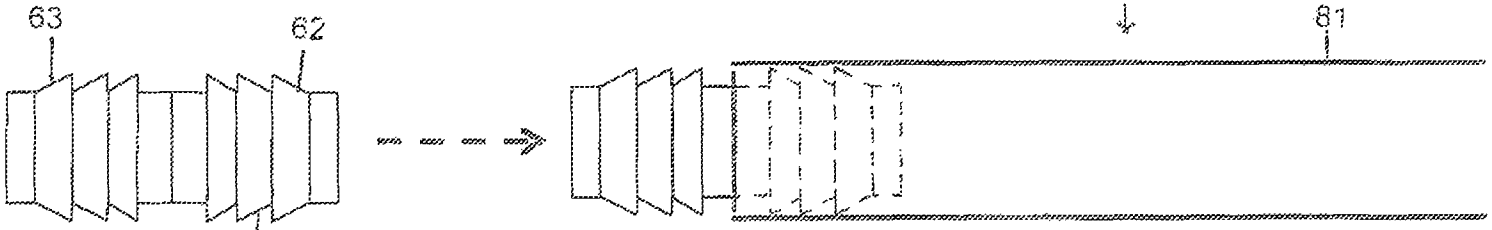
FIG. 9 is an enlarged side view of an alternate nozzle similar to that shown in FIG. 8 but for use with the plumbing drain flushing device.
Figure 10:
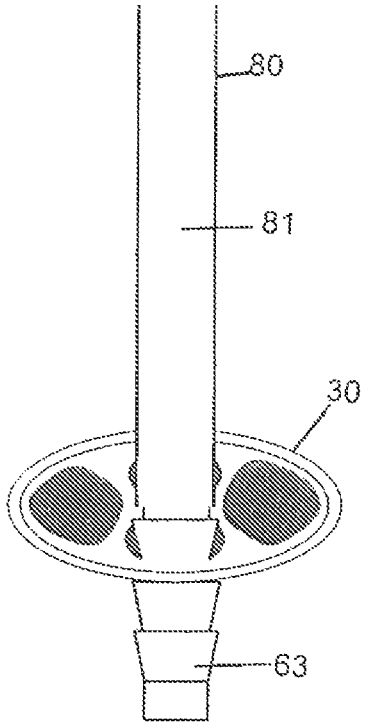
FIG. 10 is a perspective view of the plumbing drain flushing device of FIG. 9 showing the nozzle hooked onto the drain strainer.

FIGS. 8 and 9 show nozzles 60 and 62 respectively. Nozzle 60 is for use in association with plumbing trap flushing device 10 and is insertable into the conduit 20. In another embodiment of the invention there is provided a larger drain flushing device 80 which can also be seen in FIGS. 10, 19 and 21. Plumbing drain flushing device 80 essentially works the same way as the plumbing trap flushing device but it includes a flexible conduit 81 that is larger than conduit 20 and would thus be difficult to fit into some drains and in particular pop-up drains. Nozzle 62 is for use in association with plumbing drain flushing device 80. Nozzles 60, 62 each have a saw tooth outer surface 64 to facilitate insertion into the conduit 20 and 81 respectively and are designed to make it difficult to remove from the respective conduits. Nozzle 62 also includes a reverse saw tooth 63 which is adapted to catch onto a drain strainer 30 as shown in FIG. 10.

Figure 12:
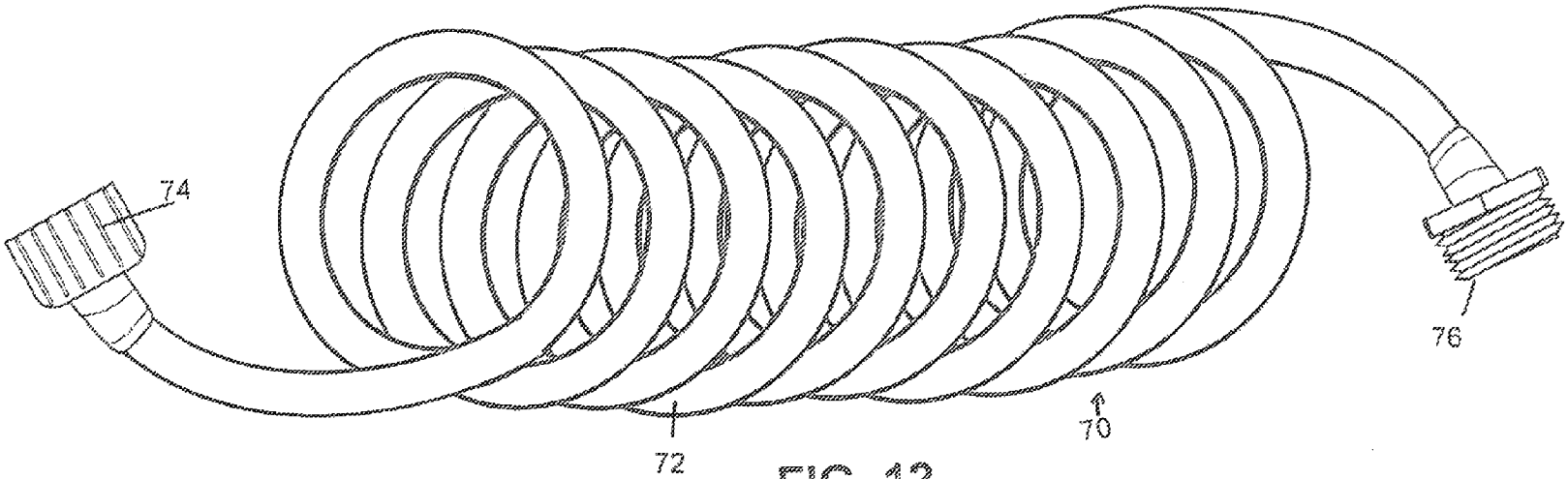
FIG. 12 is a side view of an alternate water supply extension that shown in FIG. 11 but with a self coiling conduit.
Figure 11:
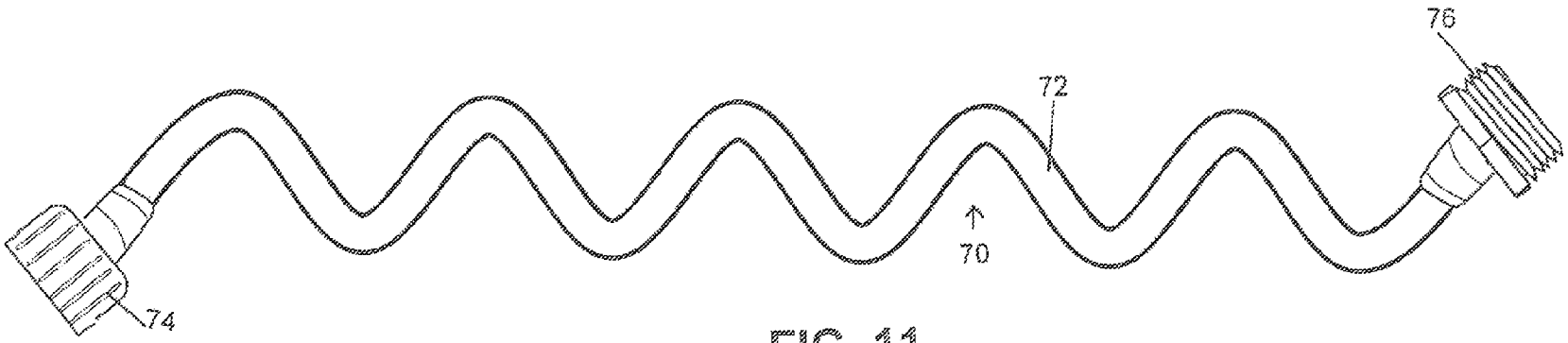
FIG. 11 is a side view of a water supply extension adapted to be attached to the plumbing trap flushing device of the present invention.
Figure 13:
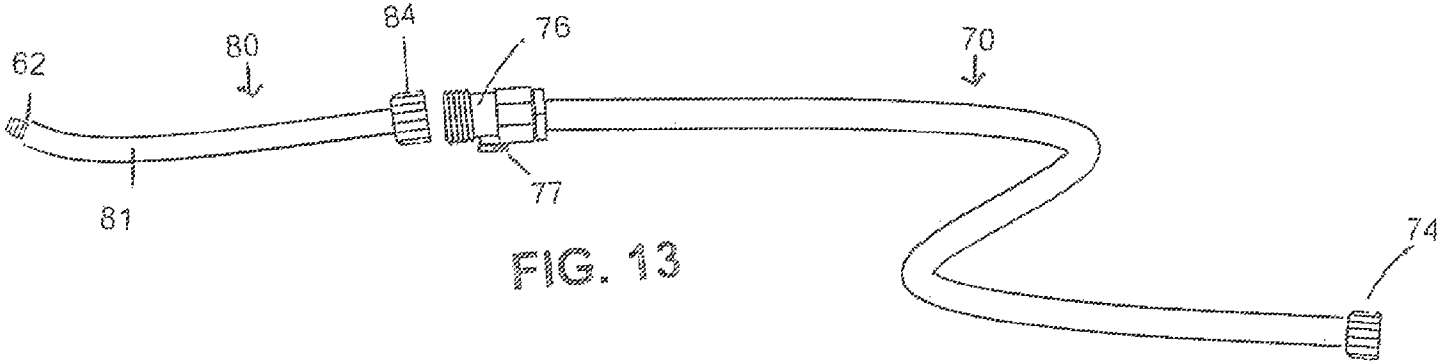
FIG. 13 is a side view of the plumbing drain flushing device attached to the water supply extension.
Figure 14:
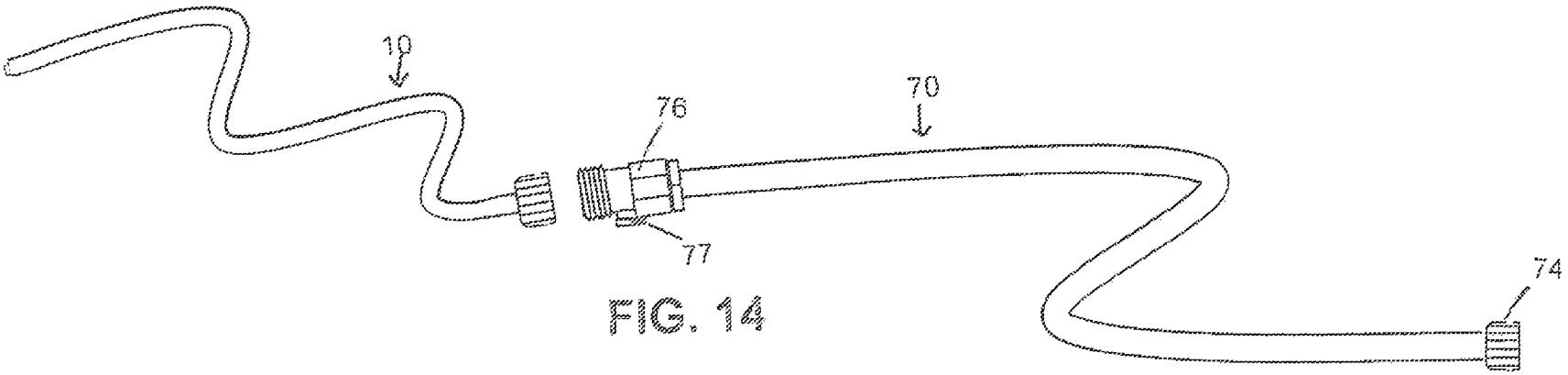
FIG. 14 is a side view of the plumbing trap flushing device attached to the water supply extension.

The plumbing trap flushing device 10 may be attached to a water supply extension 70 shown in FIGS. 11 and 12. Water supply extension 70 includes a flexible conduit 72, a connector 74 at one end thereof adapted to be connected to a spout of a tap and a connector 76 at the other end thereof adapted to be connected to the plumbing trap flushing device as shown in FIG. 14 or a plumbing drain flushing device as shown in FIG. 13. Flexible conduit may be self coiling as shown in FIG. 12.

Connector 76 may also include a shut-off valve 77 as shown in FIGS. 13 and 14. It will be appreciated by those skilled in the art that preferably the valve is one that is easily moved from fully open to fully closed. One such valve is a full bore ball valve quarter turn shut-off valve.

Figure 19:
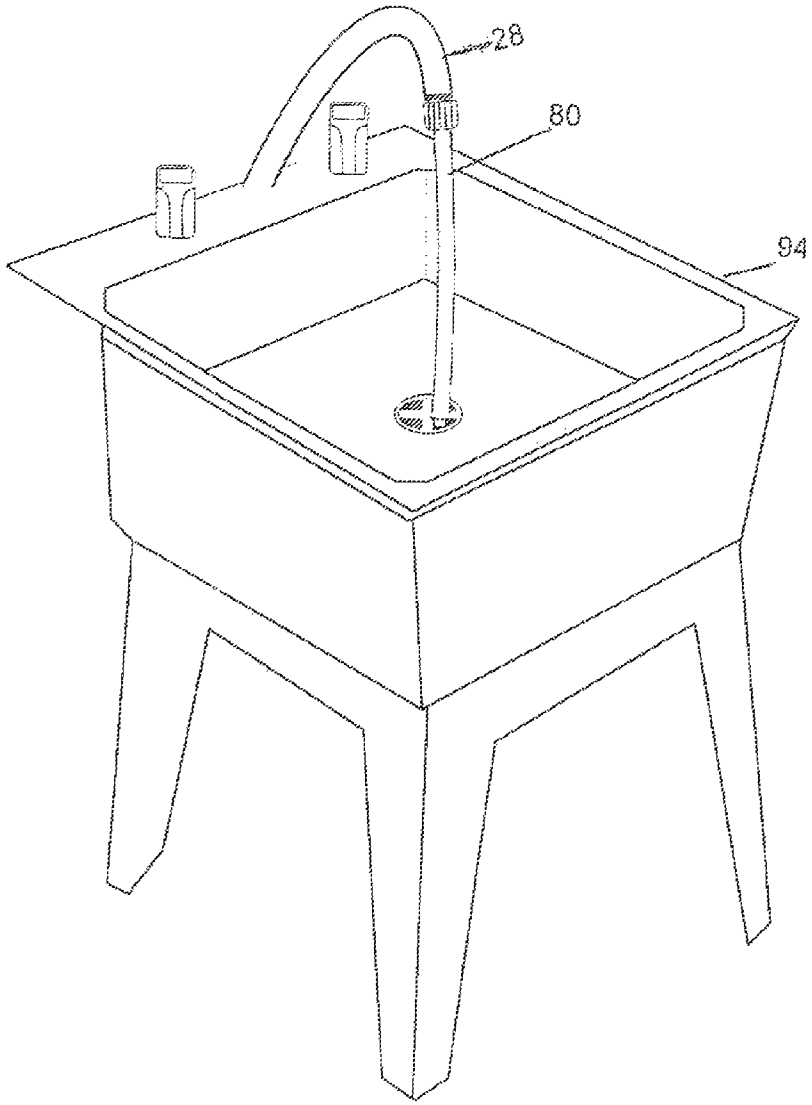
FIG. 19 is a perspective view of the plumbing drain flushing device of the present invention used in a laundry tub.
Figure 20:
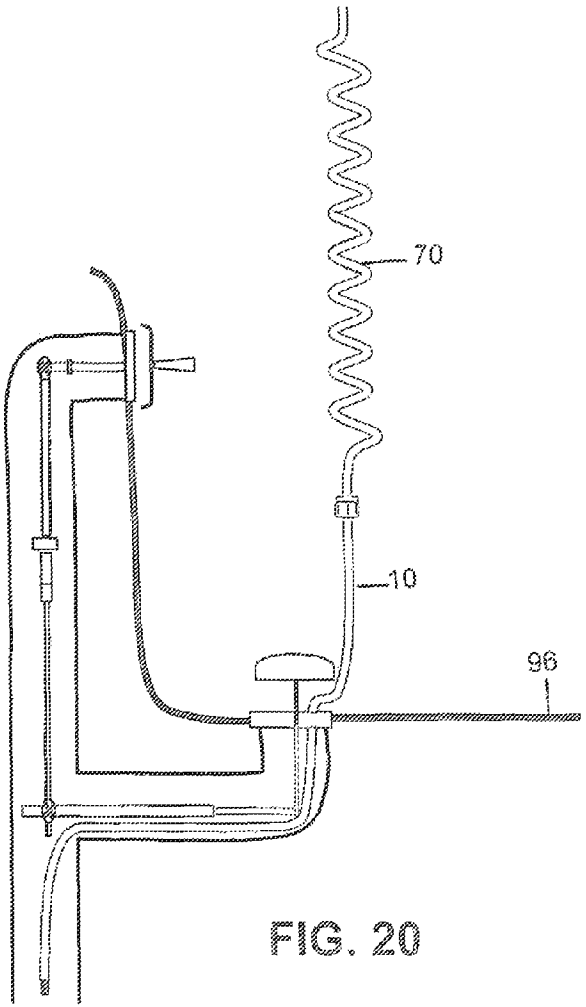
FIG. 20 is a cross-sectional view of the plumbing trap flushing device used in a pop-up drain in a tub.
Figure 21:
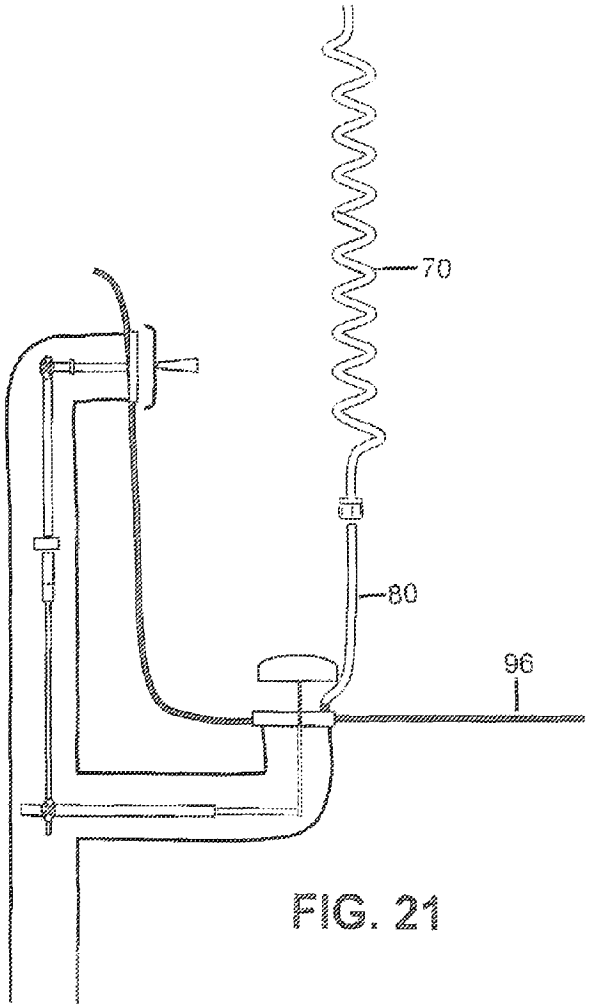
FIG. 21 is a cross-sectional view of the plumbing drain flushing device used in a pop-up drain in a tub.

A plumbing drain flushing device 80 is shown in FIG. 13. The drain flushing device 80 may also be attached to the water supply extension 70. The drain flushing device is similar to the trap flushing device and it includes a conduit 81, a connector 84 and a nozzle 62. The drain flushing device has a larger outside diameter than the trap flushing device. The drain flushing device is dimensioned to be positioned at the edge of a drain and to shoot a jet of water down the drain as shown in FIGS. 19 and 21.

Figure 16:
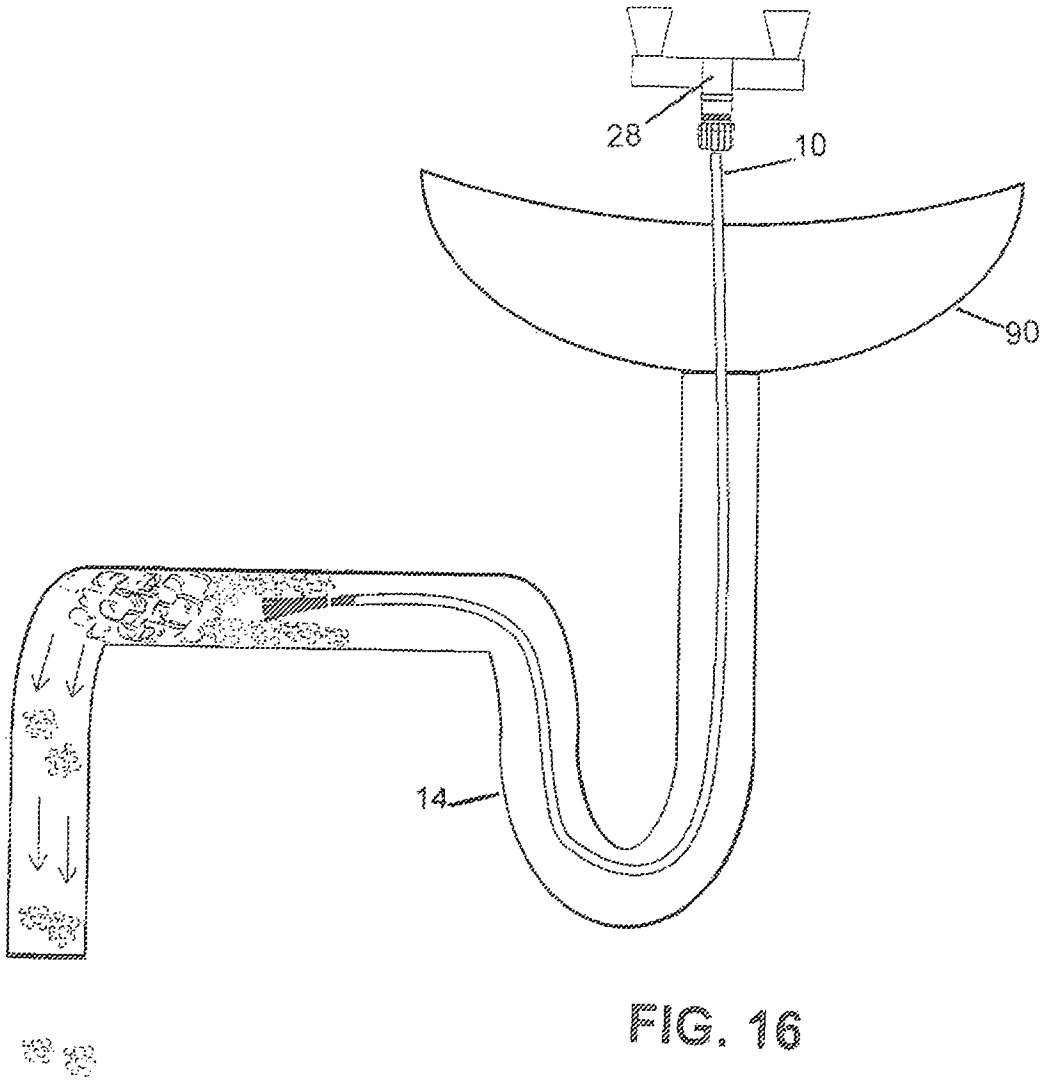
FIG. 16 is a cross-sectional view similar to that shown in FIG. 1 hut showing the clog moving through the trap and going through the end of the bend of the trap.
Figure 17:
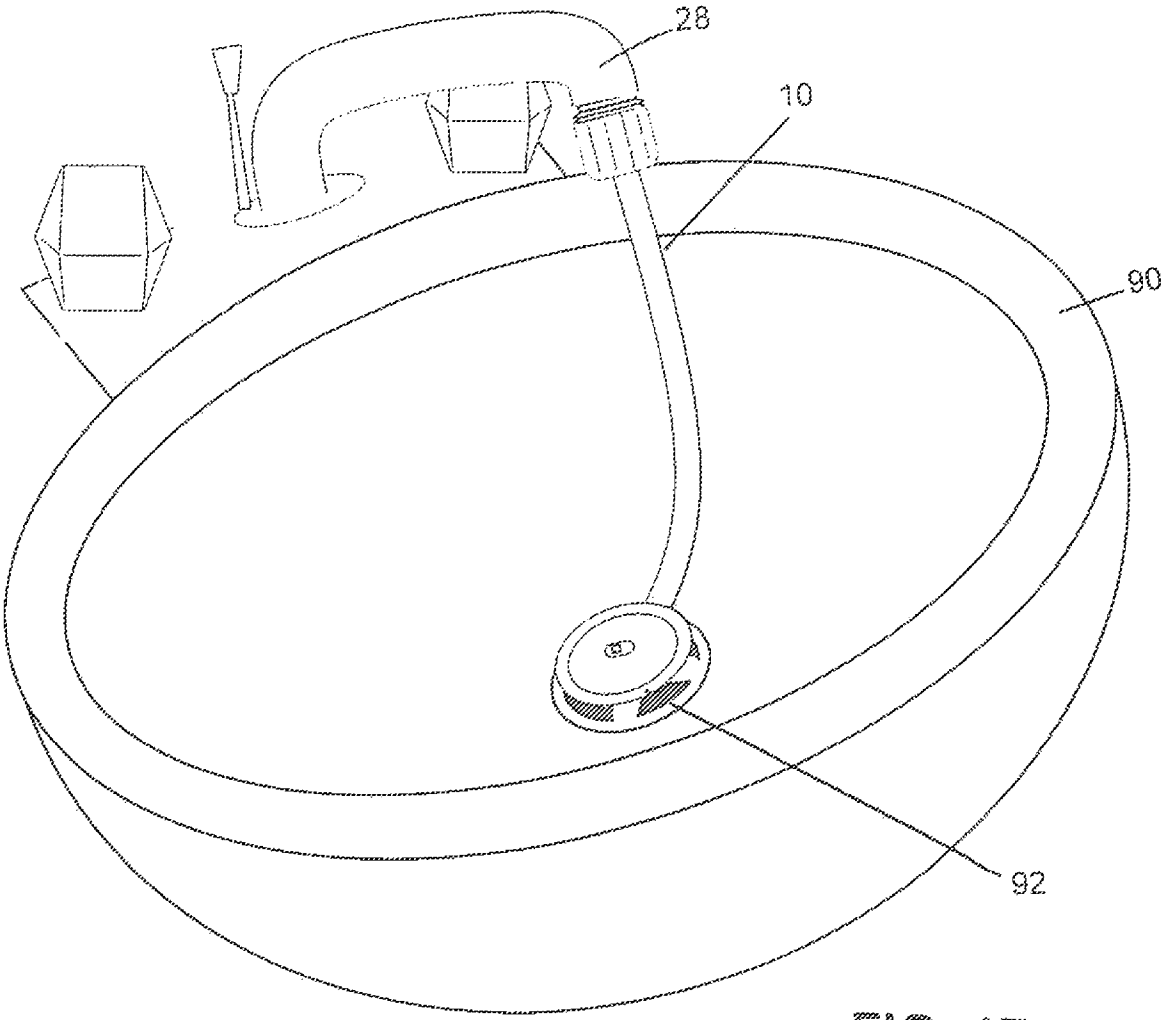
FIG. 17 is a perspective view of the plumbing trap flushing device of the present invention used in a pop-up drain in a basin.
Figure 18:
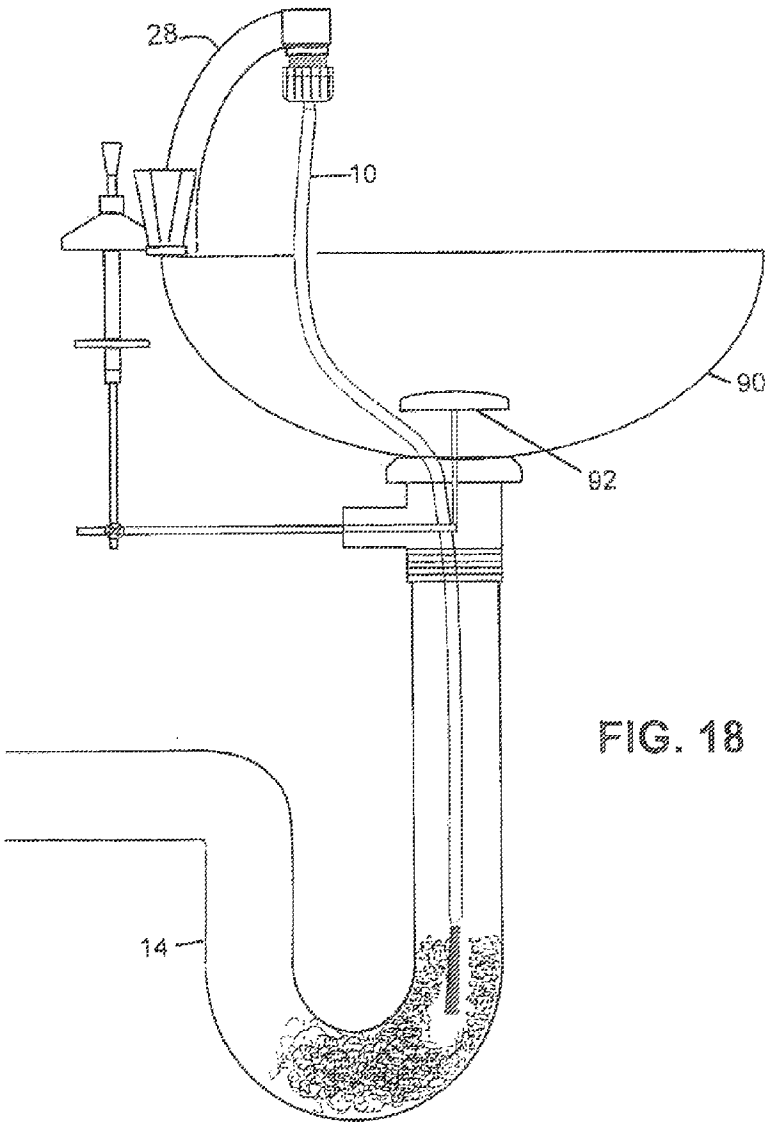
FIG. 18 is a cross-sectional view of the plumbing trap flushing device of the present invention used in a pop-up drain in a basin.
Figure 22:
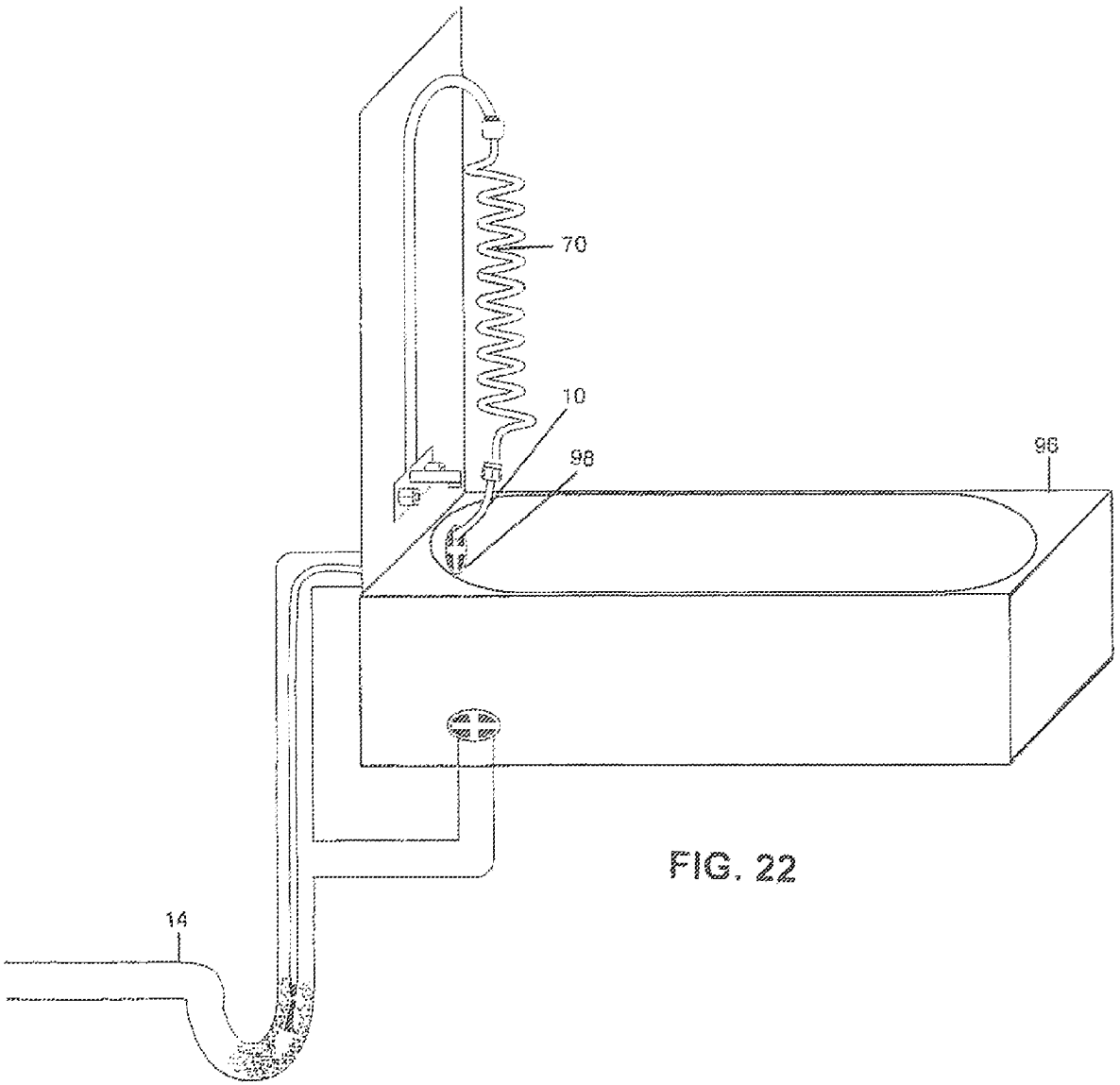
FIG. 22 is a partial perspective view of the plumbing trap flushing device use in an overflow drain in a tub.
Figure 23:
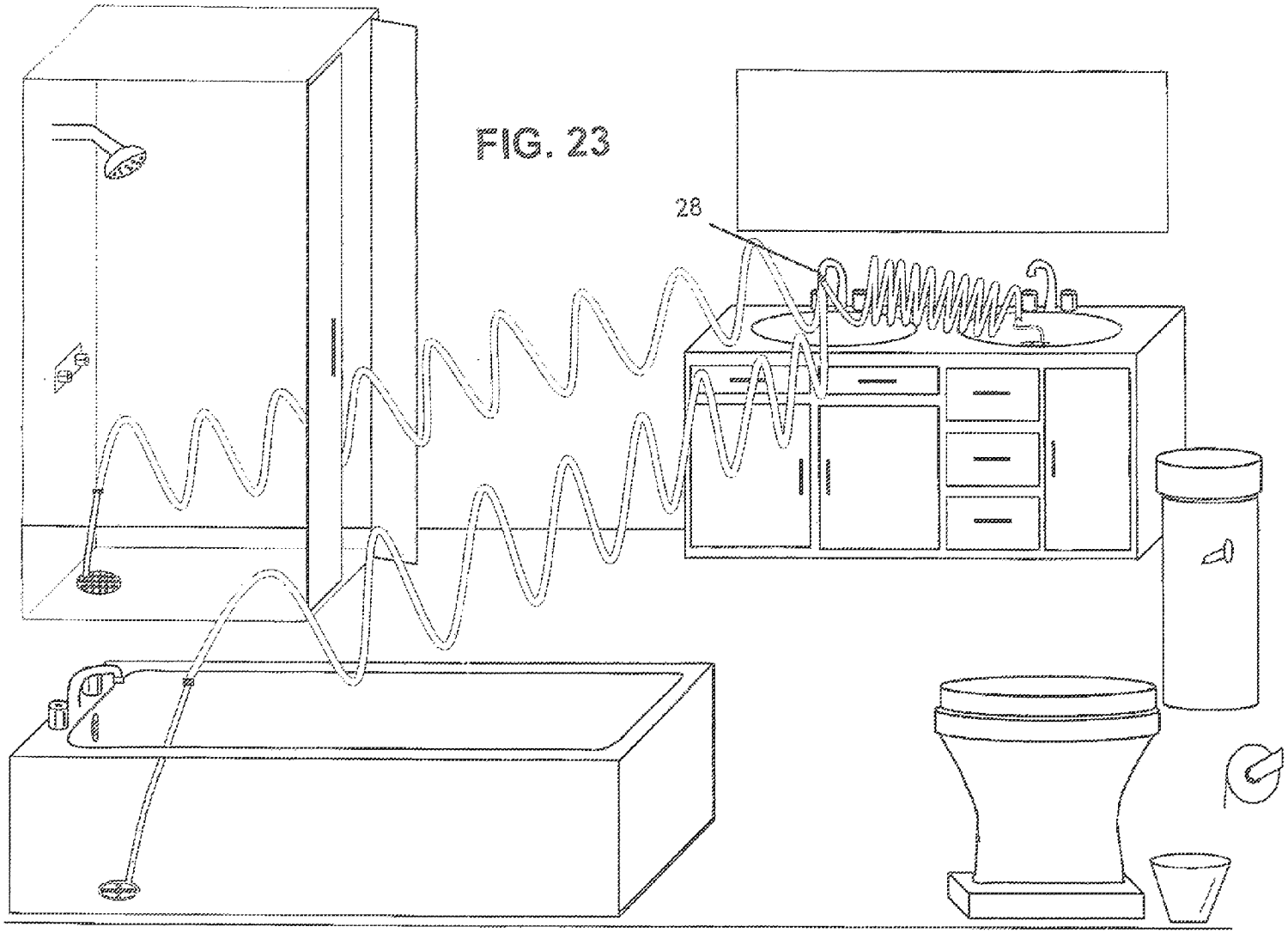
FIG. 23 is an overview of the alternative uses of the plumbing trap flushing device of the present invention as it may be used in a bathroom and attached to a spout of a tap of a basin.
Figure 24:
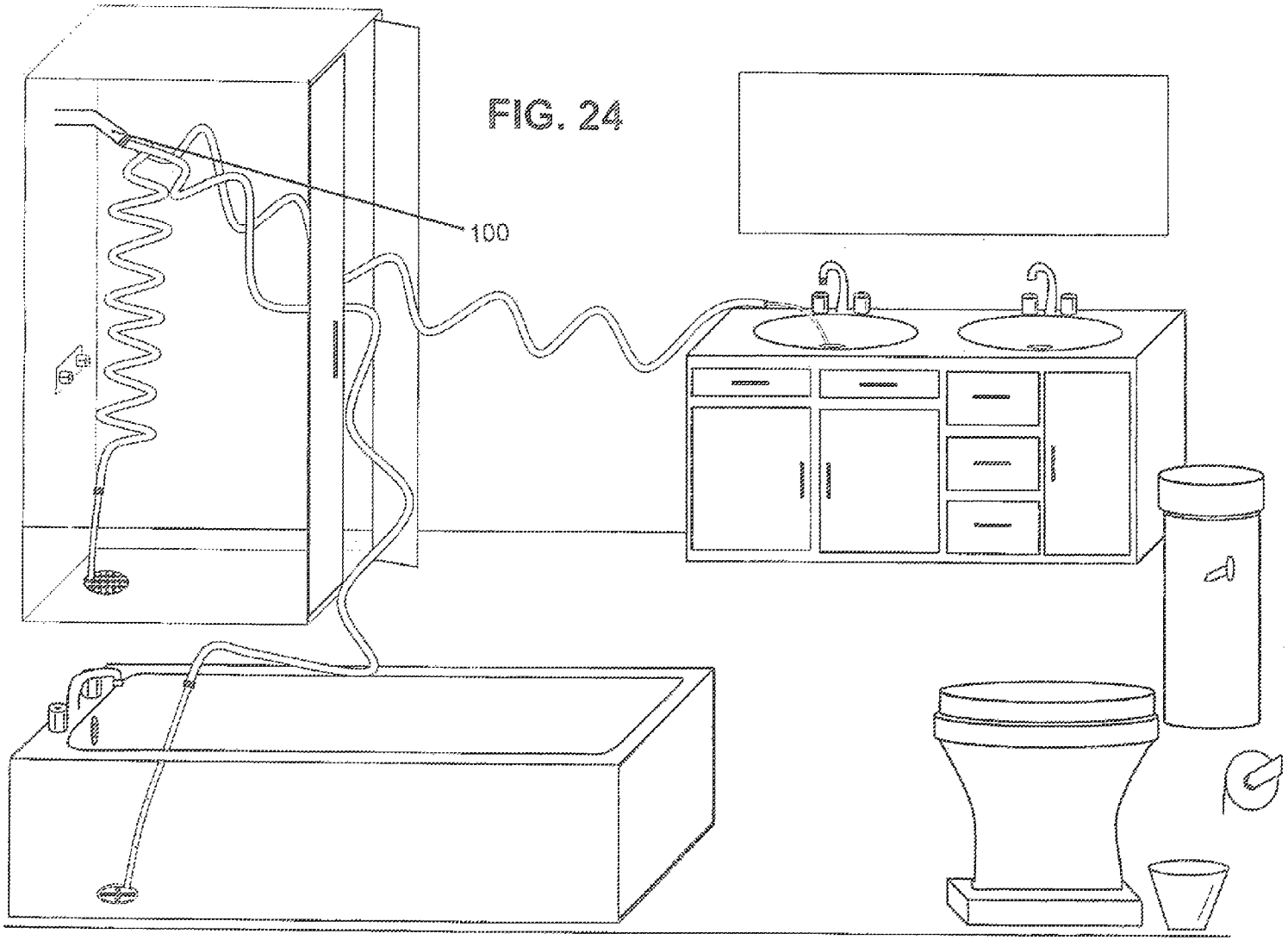
FIG. 24 is an overview similar to that shown in FIG. 23 but showing the plumbing trap flushing device attached to a shower arm.
Figure 25:
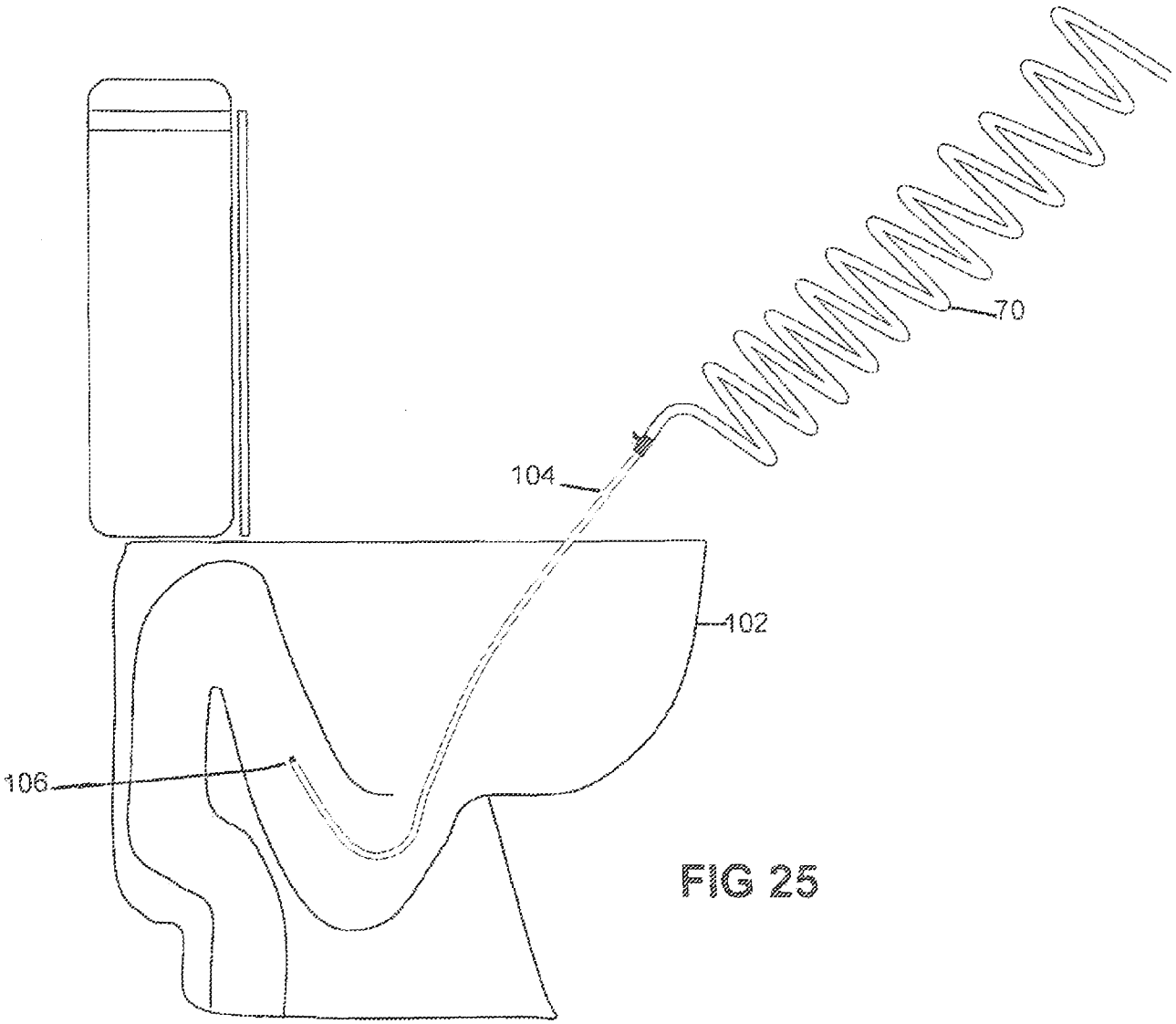
FIG. 25 is a cross-sectional view of a toilet flushing device.

As has been shown herein the plumbing trap flushing device may be used in a number of applications throughout the house. Some of these applications are illustrated in the figures herein. Specifically FIG. 15 shows the trap flushing device 10 with the nozzle 38 attached thereto and used in a conventional bathroom basin 90. FIG. 16 shows the trap flushing device 10 as it breaks up the clog and moves it through the trap 14 and used in a conventional bathroom basin 90. As can be seen the trap flushing device 10 can essentially chase the clog through the trap. As discussed above trap flushing device 10 is dimensioned to be used in a pop-up type drain strainer 92 as shown in FIGS. 17 and 18. Trap flushing device 10 is flexible enough so that it can be pushed around pop-up type drain strainer 92. The drain flushing device 80 may be used in a variety of different applications and it is shown in FIG. 19 in a utility type sink 94. The drain flushing device 80 may also be used with the water supply extension 70. It may be used in a tub 96 as shown in FIG. 21. Alternatively the trap flushing device 10 may be used in association with the water supply extension 70 in a tub 96. The trap flushing device 10 may also be used in the overflow drain 98 as shown in FIG. 22. Examples of how either the plumbing trap flushing device 10 or the plumbing drain flushing device 80 may be attached in a typical bathroom are shown in FIGS. 23 and 24. As shown the devices may be attached to spout 28 (FIG. 23) or shower arm 100 (FIG. 24). As can be seen in FIG. 23 the plumbing trap flushing device may attached to a water supply extension and then to a spout 28 of a tap 29 and used alternatively in a basin, a shower or a tub. Similarly as shown in FIG. 24 the plumbing trap flushing device may be attached to a water supply extension and then to a shower arm 100 and used alternatively in a basin, a shower or a tub. It should be noted that while FIGS. 23 and 24 show the plumbing trap flushing device use in different devices this is by way of example only and the plumbing trap flushing device would only be used in one device at a time. As well the device may be adapted to be used in a toilet 102 as shown in FIG. 25. The toilet flushing device 104 works the same way as the device described above but the dimensions might vary. As well, most households would likely use a separate device exclusively for the toilets.

Figure 38:
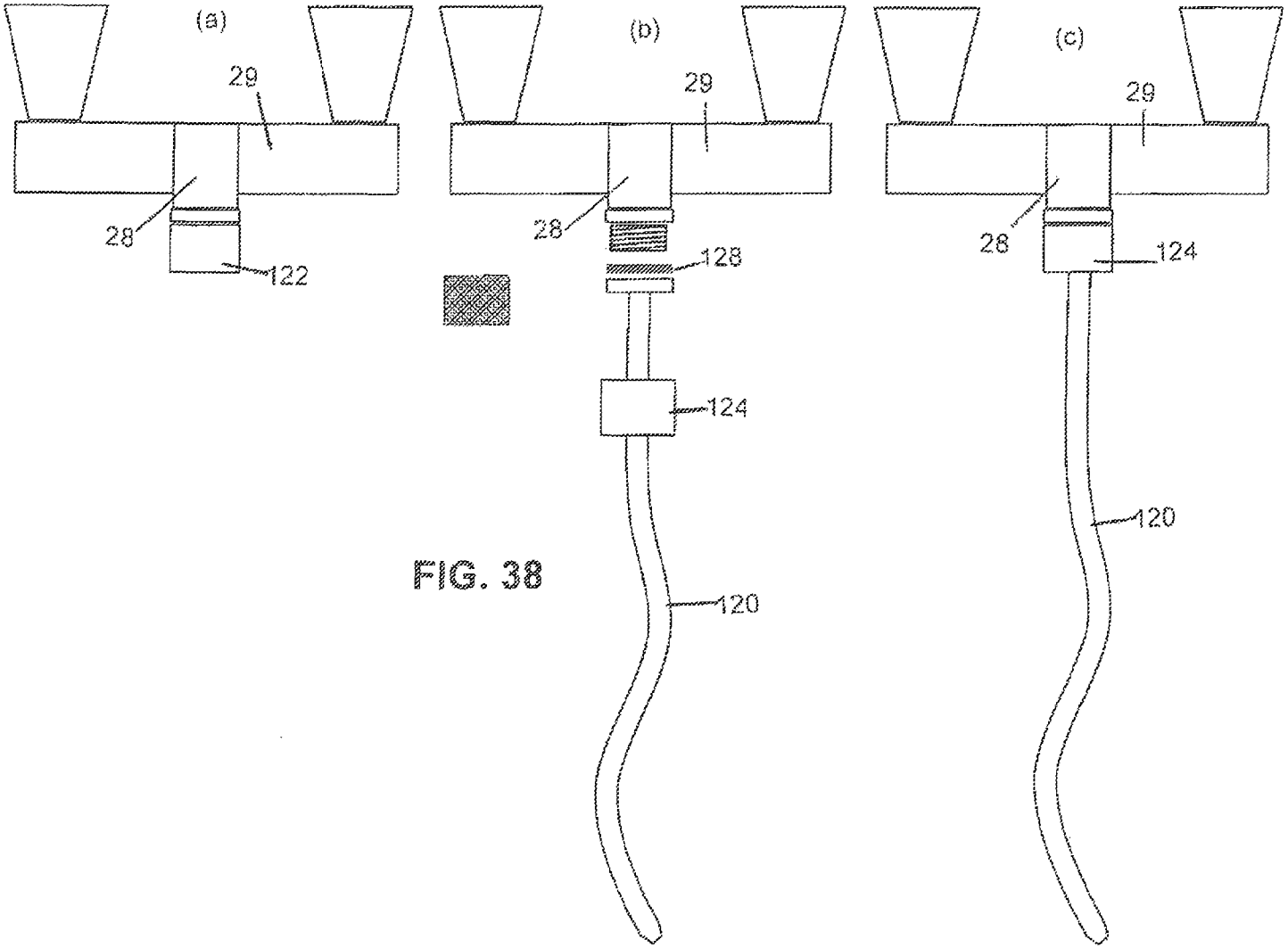
FIGS. 38 (*a*), (*b*), and (*c*) are the steps in attaching the plumbing trap flushing device shown in FIGS. 26 to 36 to a faucet.

FIGS. 26 to 37 show a number of different embodiments of an alternate embodiment of the plumbing trap flushing device of the present invention. FIG. 38 shows how the alternate embodiments work. The plumbing trap flushing device 120 is attachable to be attached to the aerator 122 on the spout 28 of the faucet or tap 29. An aerator typically includes a housing 124 and a screen 126 and other flow regulating parts which are commonly referred to as the "guts" that fit inside the housing. A washer 128 typically is positioned above the screen inside the housing 124 to ensure a good seal between the aerator and the spout 28. In use the aerator is removed from the spout 28, the screen 126 is removed from the aerator 122 and the plumbing trap flushing device 120 is positioned in the housing 124. The washer 128 is positioned over the plumbing trap flushing device 120 and the housing 124 is reattached to the spout 28. The advantage of this configuration is that the user is using the spout's existing housing of the aerator to attach the plumbing trap flushing device 120. Accordingly there are no issues about ensuring that the user has the correct thread size and attachment size.

Figure 26:
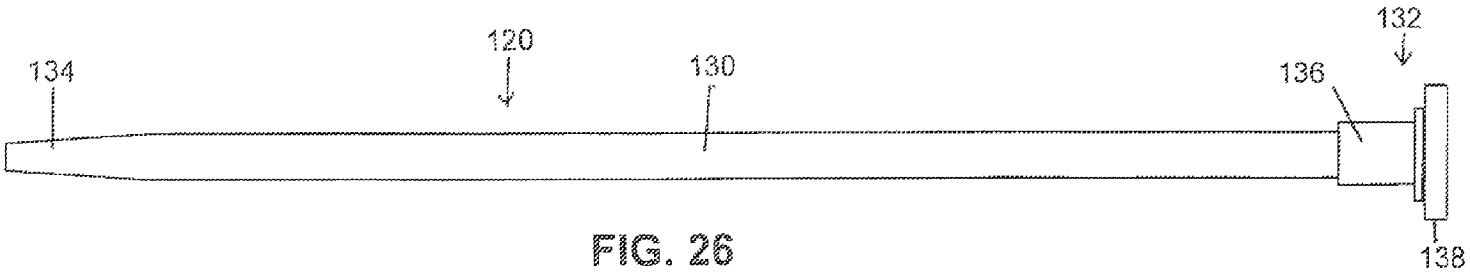
FIG. 26 is a side view of an alternate embodiment of the plumbing trap flushing device showing an alternate connector.

Referring to FIG. 26 the plumbing trap flushing device 120 includes a conduit 130 and a connector 132. The conduit 130 has a nozzle portion 134 integrally formed therein. The connector 132 has a conduit portion 136 and a flange portion 138. The flange portion 138 is adapted to engage the housing 124 of the aerator 122. It will be appreciated by those skilled in the art that connector 132 to also be used with conduit 20 and nozzle 22. Similarly, alternate nozzles could be used.

Figure 27:
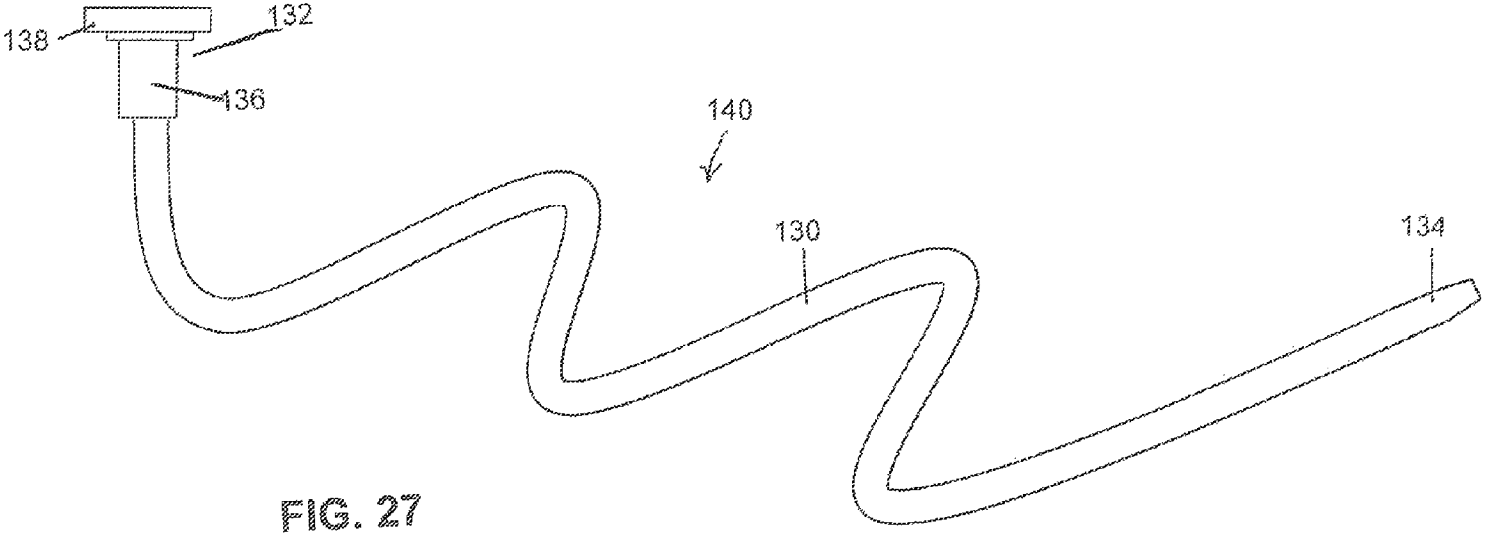
FIG. 27 is a side view of an alternate embodiment of the plumbing trap flushing device similar to that shown in FIG. 26 but having a long conduit.

Referring to FIG. 27, the plumbing trap flushing device 140 is similar to that shown in FIG. 26 but the conduit 130 is longer.

Figure 28:
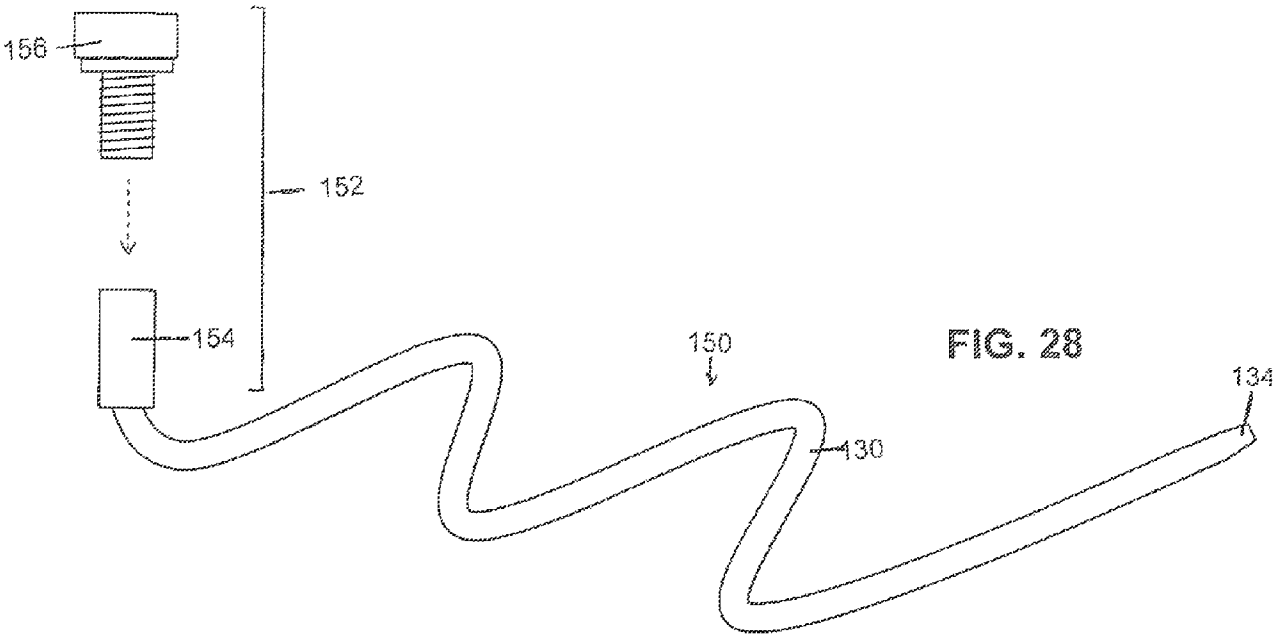
FIG. 28 is a blown apart side view of an alternate embodiment of the plumbing trap flushing device similar to that shown in FIG. 27 but showing an alternate connector having two detachable portions.
Figure 29:
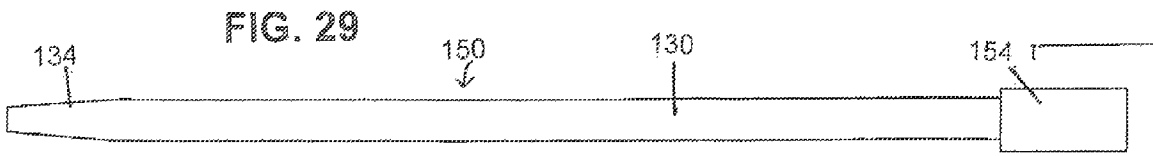
FIG. 29 is a blown apart side view of an alternate embodiment of the plumbing trap flushing device similar to that shown in FIG. 28 but showing an alternate size.
Figure 30:
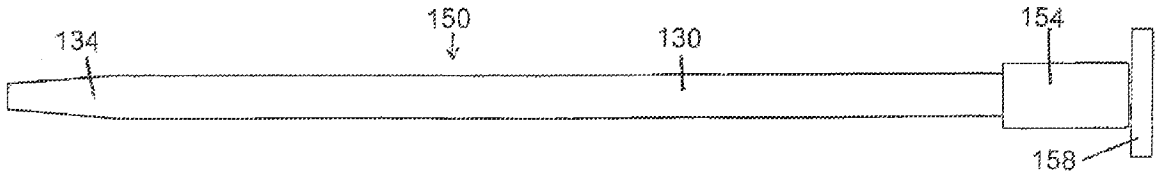
FIG. 30 is a side view of plumbing trap flushing device shown in FIG. 29 but showing the connector assembled.

Referring to FIGS. 28 to 36 the plumbing trap flushing device 15' is similar to those shown in FIGS. 26 and 27 but the connector 152 has two detachable portions namely the conduit portion 154 and the attachable flange portions 156 shown in FIGS. 28 and 158 shown in FIG. 29. Alternate detachable flange portions are provided so that plumbing trap flushing device 150 is attachable to different sized aerators. It will be appreciated by those skilled in the art that connector 132 could have various dimensions to fit into various sized aerators.

Figure 31:
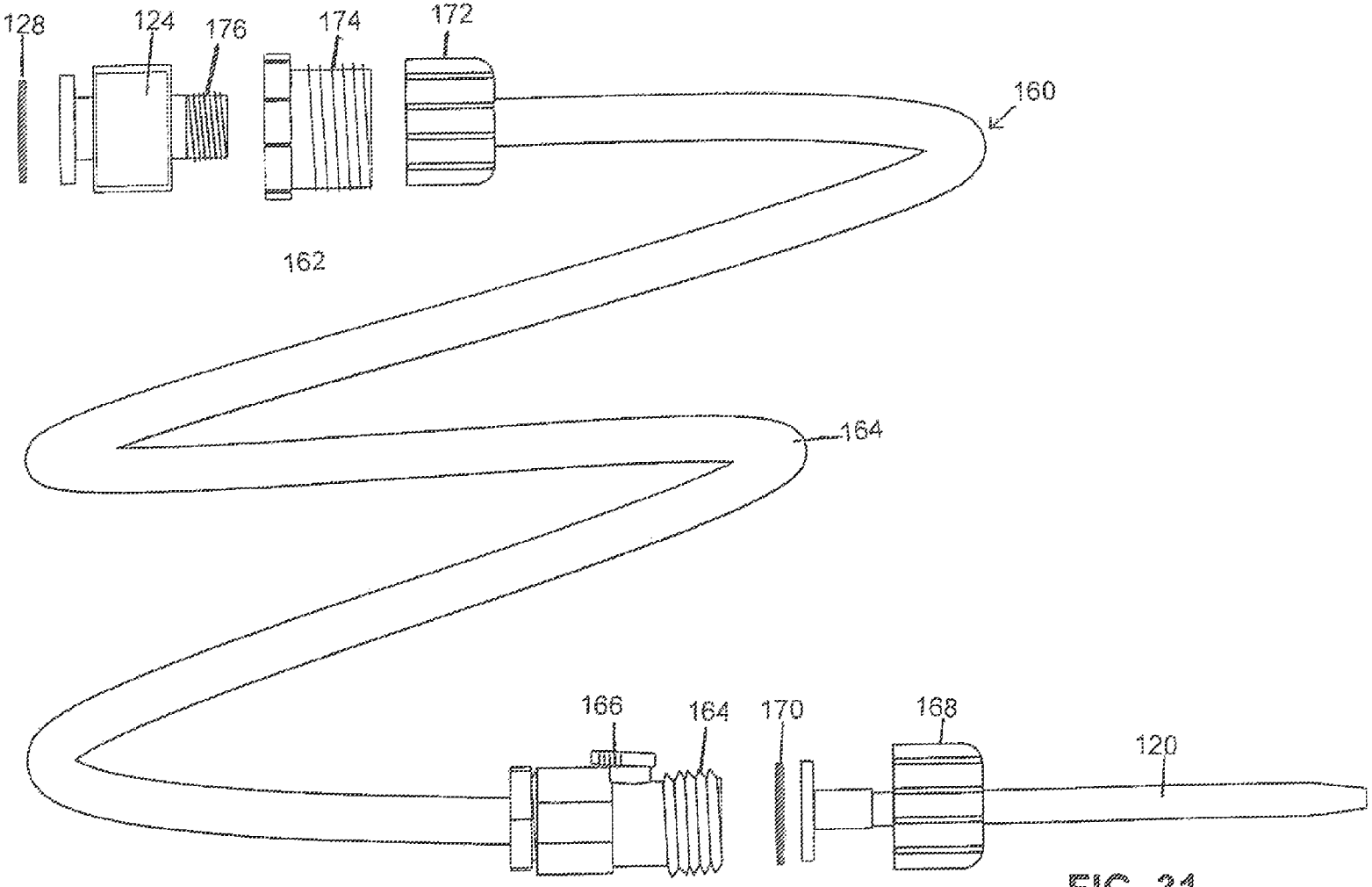
FIG. 31 is a blown apart side view of a connector similar to that shown in FIG. 26 but showing it with alternate embodiment of a water supply extension.

Referring to FIG. 31 the plumbing trap flushing device 120 is attached to a water supply extension 160. The water supply extension 160 is similar to that described above in regard to water supply extension 70 however it has an alternate faucet connector 162. Water supply extension 160 includes a conduit 164 a faucet connector 162 at one end thereof and a connector 164 at the other end thereof. Preferably connector 164 has a shut-off valve 166. Connector 164 has a cover 168 attachable thereto and a washer 170 for use therein. In use plumbing trap flushing device 120 or 140 or 150 is positioned in the cover 168 a washer 170 is inserted therein and the cover is attached to connector 164.

Figures 32, 33, 34, 35, 36, 37:
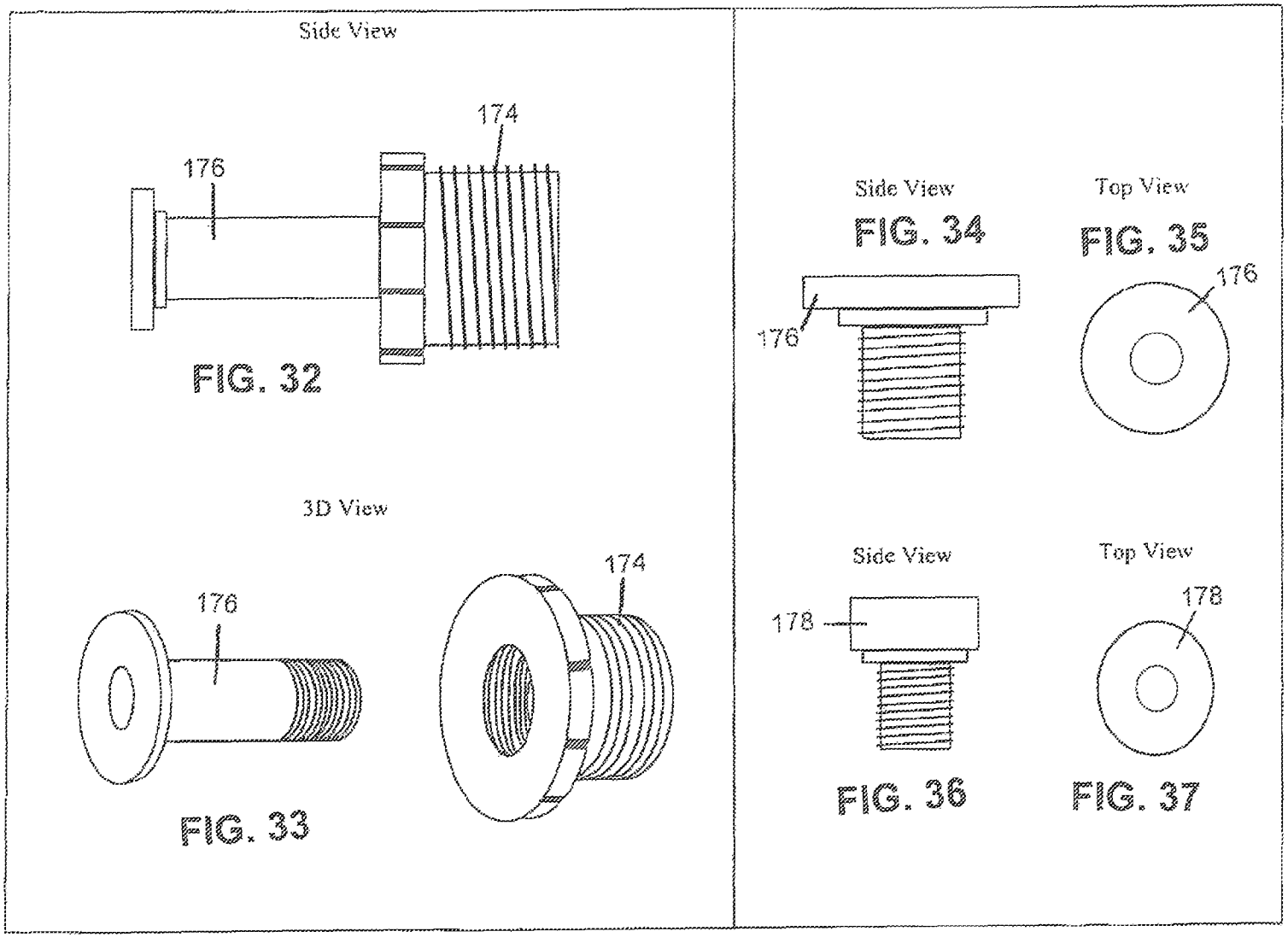
FIG. 32 is a side view of the connector for use with the water supply extension of FIG. 31.
FIG. 33 is a blown apart perspective view of the connector of FIG. 32.
FIG. 34 is a side view of the connector of FIG. 32.
FIG. 35 is a top view of the connector of FIG. 32.
FIG. 36 is a side view of a connector similar to that shown in FIG. 33 but having a different dimension.
FIG. 37 is a top view of the connector of FIG. 36.

Connector 162 includes a conduit portion 172, an intermediate portion 174 and a flange portion 176. Intermediate portion 174 is releasably connectable to conduit portion 172 and flange portion is releasably connectable to intermediate portion. Connector 162 is adapted to be connected to a faucet. Flange portion is inserted through the aerator housing 124 and washer 128 is positioned thereon. Housing 124 is then attached to the spout 28 (not shown). Range portion is attached to intermediate portion 174 and intermediate portion is attached to conduit portion 172. It will be appreciated by those skilled in the art that the order in which these portions of connector 162 may be determined by the user. Referring to FIGS. 32 to 37 some more details of the flange portion 176 and intermediate portion 174 are shown. It will be appreciated by those skilled in the art that alternate dimensioned flange portions may be required to fit into different sized aerators. An alternate sized flange portion 178 is shown in FIGS. 36 and 37.

Figure 39:
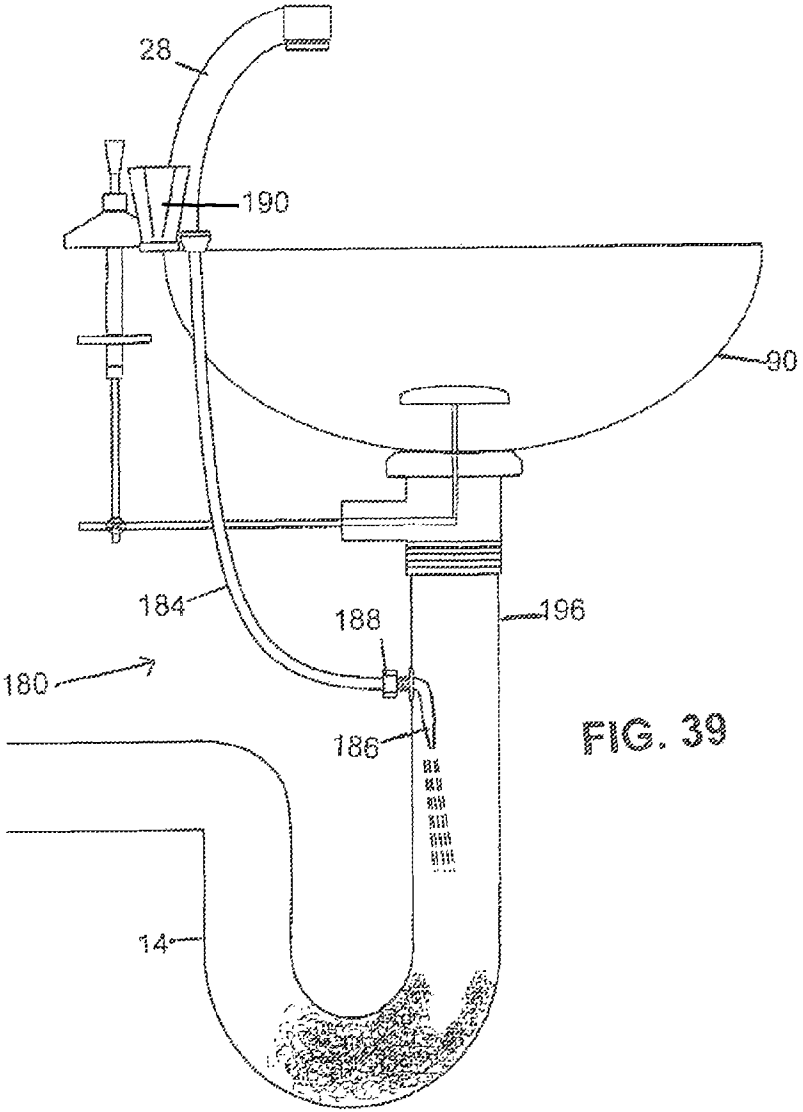
FIG. 39 is a sectional view of an embodiment of the plumbing trap flushing device wherein device forms a permanent part of the sink assembly.
Figure 41:
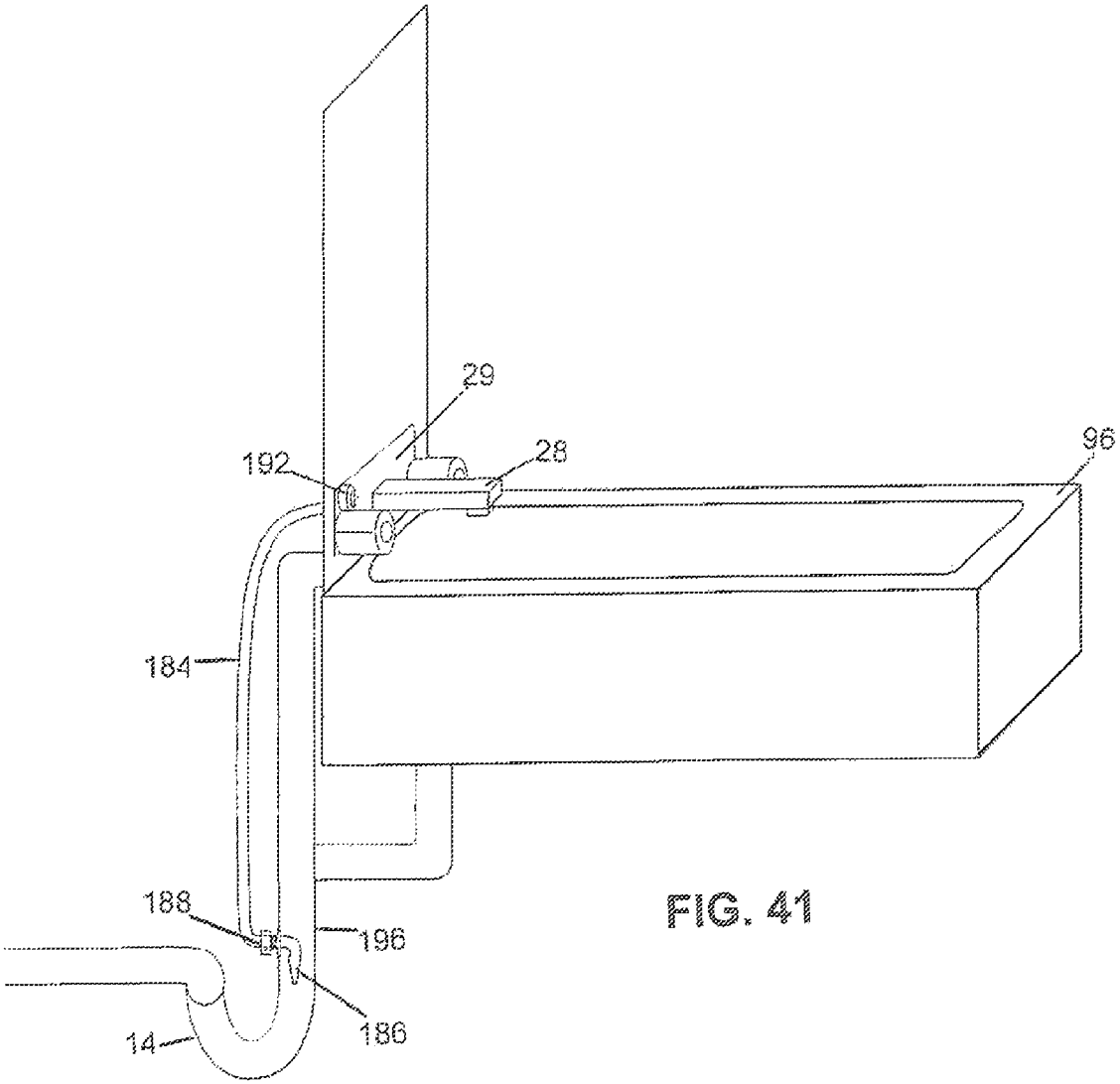
FIG. 41 is a side perspective view of an embodiment of the plumbing trap flushing assembly wherein the device forms a permanent part of the tub assembly.
Figure 42:
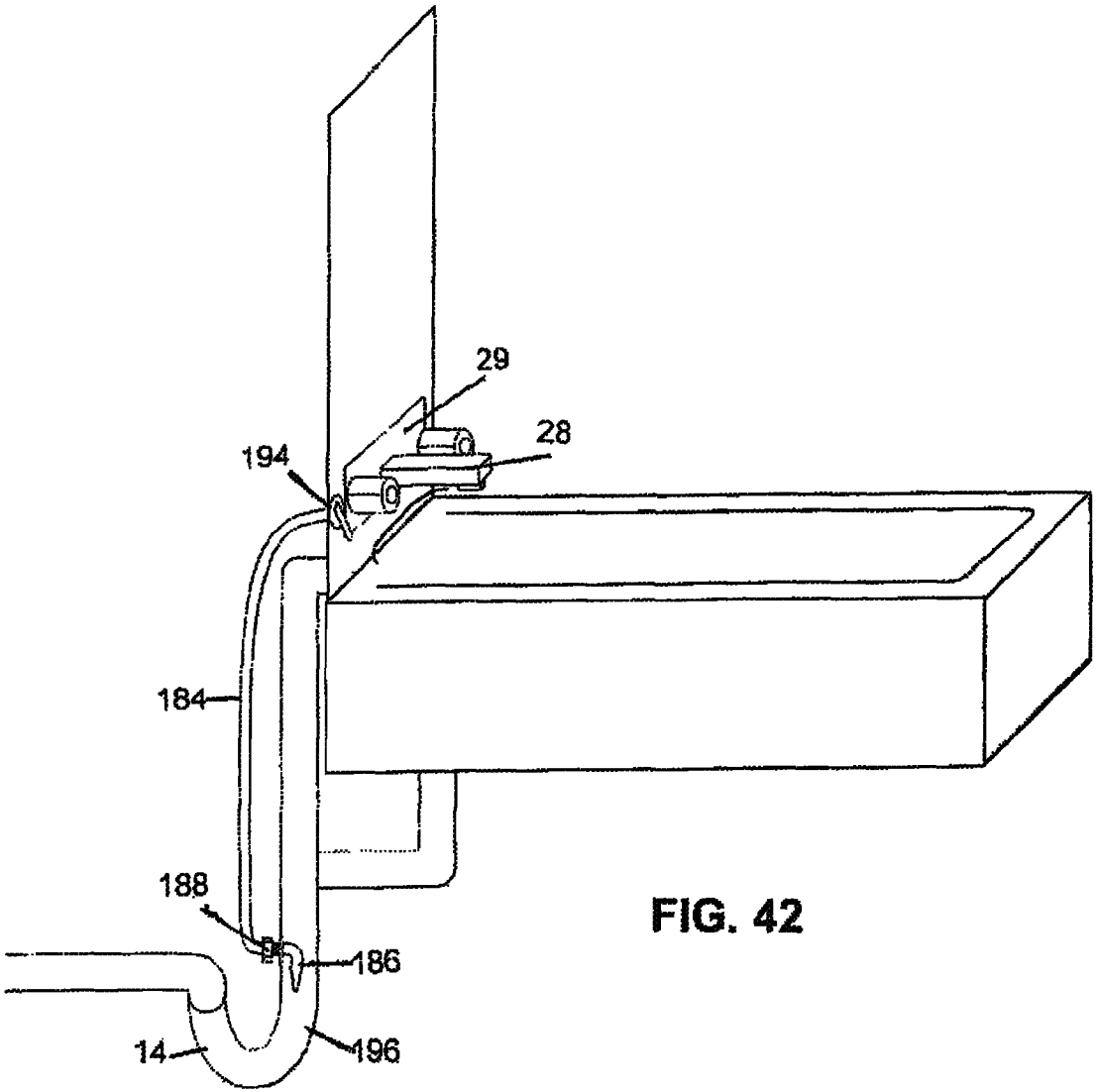
FIG. 42 is a side perspective view of an embodiment of the plumbing trap flushing assembly similar to that shown in FIG. 41 but showing a lever activator.
Figure 43:
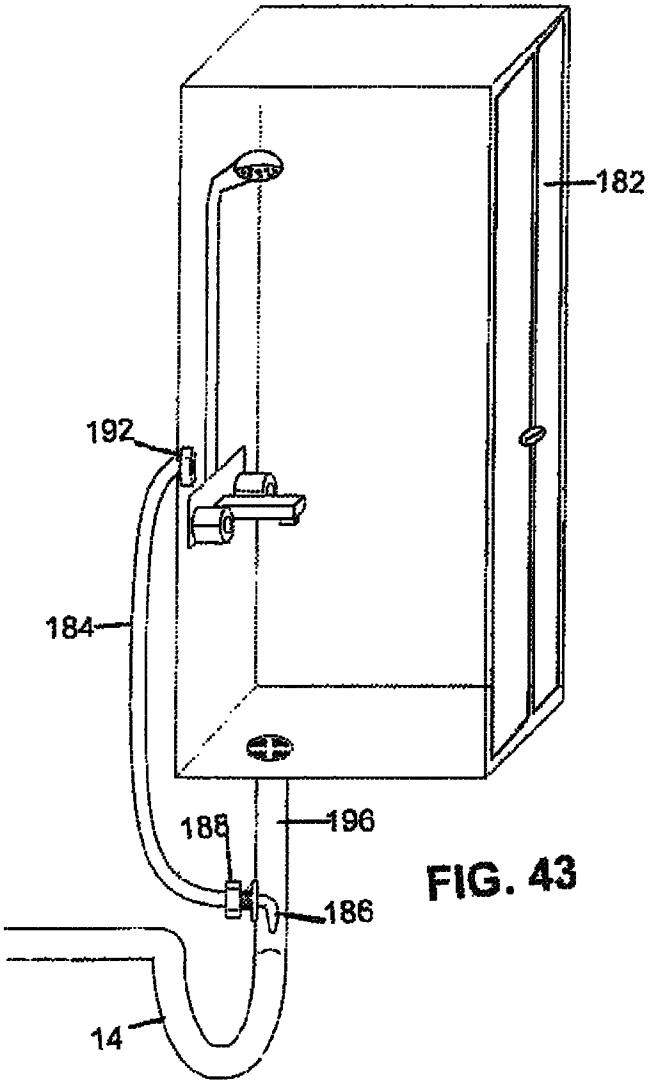
FIG. 43 is a side perspective view of an embodiment of the plumbing trap flushing assembly wherein the device forms a permanent part of the shower assembly.
Figure 44:
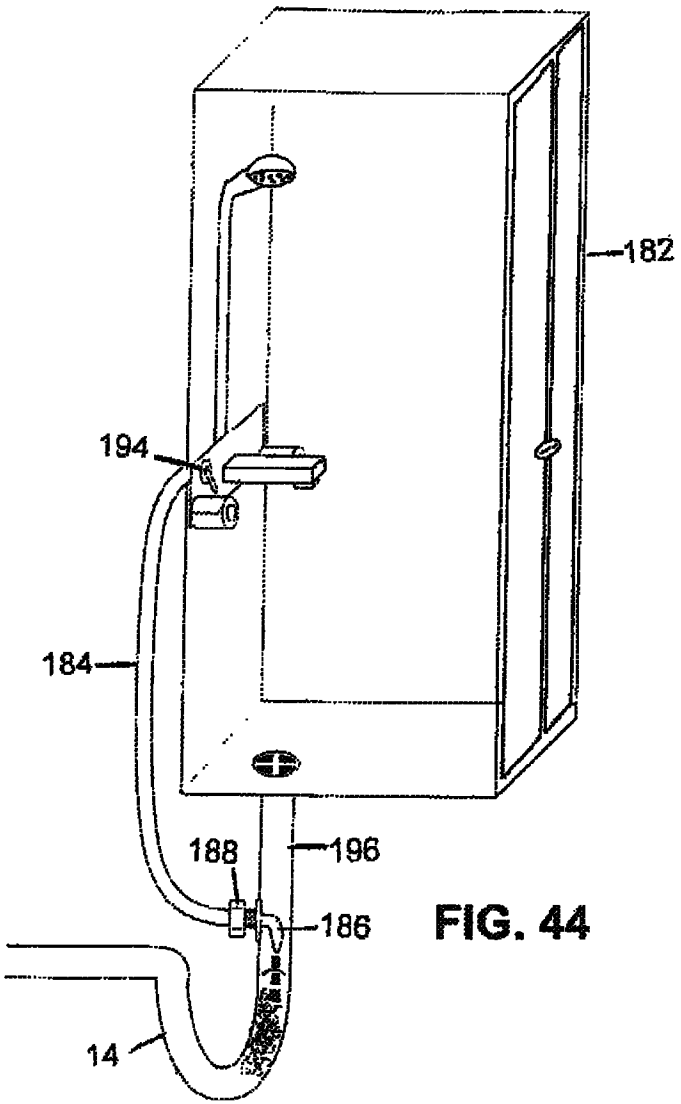
FIG. 44 is a side perspective view of an embodiment of the plumbing trap flushing assembly similar to that shown in FIG. 43 but showing a lever activator.

It will be appreciated by those skilled in the art that it would also be advantageous to have the plumbing trap flushing assembly 180 permanently installed in a sink as shown in FIG. 39, a tub 96 as shown in FIGS. 41 and 42 or a shower 182 as shown in FIGS. 43 and 44. Thus whenever the user's drain is slow to empty the user may activate the plumbing trap flushing device 180 to flush the trap.

Plumbing trap flushing assembly 180 is designed to be permanently installed but it serves the same function as the alternate embodiments described above. Plumbing trap flushing assembly has a conduit 184 a nozzle 186 a nozzle connector 188 and an activator 190. The activator 190 is positioned in a location that is readily accessible to the user. The activator is operably connected to a water source (not shown) and a conduit 184. The activator 190 operably turns on and off the water source to the conduit 184. The activator 190 may be a stand-alone type activator similar to a separate tap with a water filter attached thereto. Alternatively the activator could be part of a faucet assembly wherein when the tap is turned on and the activator is activated the water is diverted to the plumbing trap flushing assembly 180. This would be similar to faucet assemblies that have a sprayer and when the sprayer is activated the water is diverted from the spout to the sprayer. Accordingly the plumbing trap flushing assembly could be part of an OEM (original equipment manufacturer) faucet assembly with trap flushing device. Alternatively it could be a stand-alone unit that is a plumbing trap flushing assembly.

Figure 40:
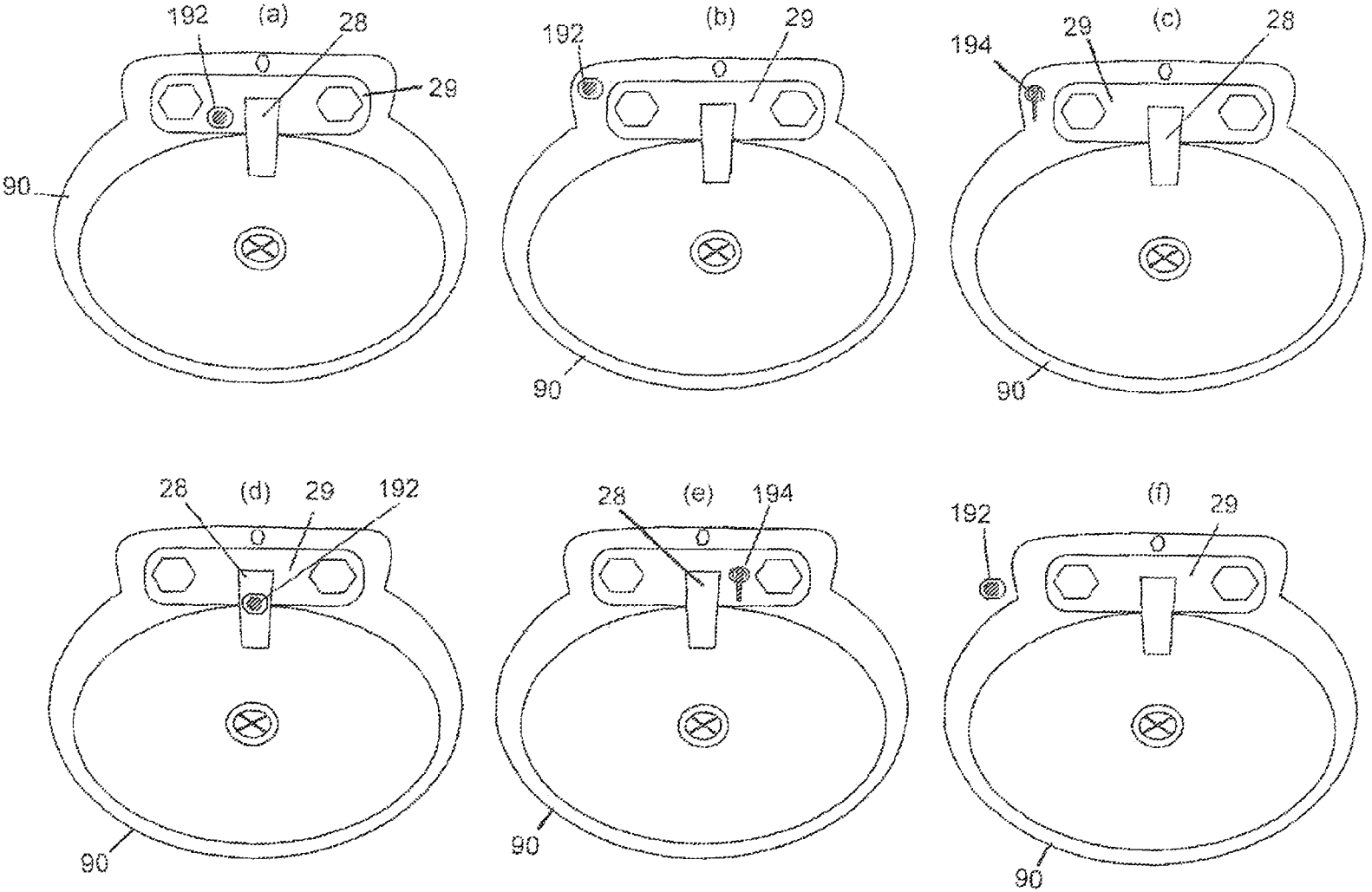
FIG. 40 (*a*) to (*f*) show alternate positions of the activator of the plumbing trap flushing device of FIG. 39.

The conduit 184 of the plumbing trap flushing assembly 180 extends between the activator 190 and the nozzle. The nozzle is positioned in the pipe 196 above or upstream of the trap 14. The nozzle extends through the pipe 196 and the nozzle connector attached to the nozzle 186. The nozzle 186 is positioned such that the stream of water exiting the nozzle is directed towards the trap 14. The conduit 184 is attached to a water source (not shown). The activator may have a number of different locations around the sink as shown some non-limiting examples in FIG. 40. Specifically it could be a push button 192 adjacent to the faucet as shown in (a), a push button 192 beside the taps as shown in (b); a lever 194 beside the taps as shown in (c), a push button as shown in (d), a lever 194 adjacent to the faucet as shown in (e), or a push button on the counter beside the sink as shown in (f). Referring to FIGS. 41 and 42 plumbing trap flushing device 180 can be installed in a tub 96. The position of the activator may be of a type and in a location wherever convenient and two possibilities are a push button 192 adjacent the faucet as shown in FIG. 41 and a lever 194 adjacent the faucet fixture as shown in FIG. 42. Referring to FIGS. 43 and 44 plumbing trap flushing device 180 can be installed in a tub shower 182. The position of the activator may be of a type and in a location wherever convenient and two possibilities are a push button 192 adjacent the faucet fixture as shown in FIG. 43 and a lever 194 adjacent the faucet as shown in FIG. 44.

It will be appreciated by those skilled in the art that the elements of this invention may be made with a wide variety of materials and in a wide variety of dimensions while still staying within the parameters described herein. For example the outside diameter of the flexible conduit 20, 130 of the different embodiments of the plumbing trap flushing device is preferably dimensioned to fit into a pop-up drain. The inside diameters of the conduit 20 and the nozzle 22 of the plumbing trap flushing device 10 are chosen such that from the spout to the nozzle the inside diameter decreases at each stage. Similarly, the inside diameters of the conduit 81 and the nozzle 62 of the plumbing drain flushing device 80 are chosen such that from the spout to the nozzle the inside diameter decreases at each stage. As well, the inside diameters of the conduit and the nozzle of the toilet flushing device 104 are chosen such that from the spout to the nozzle the inside diameter decreases at each stage. The inside diameter of the water supply extension 70, 164 is chosen such that the inside diameter is equal to or less than the inside diameter of the spout and greater than the insider diameter of the conduit of the trap flushing device 10, 120 and/or the drain flushing device 80 and/or the toilet flushing device 104. Accordingly the outside diameter and inside diameter of each device may vary greatly. However, typically one would choose from materials that are readily available. The following sizes are by way of example only. The inside diameter of the conduit 20, 130 is dimensioned to be as large as possible when considering the constraint of the outside diameter. The outside diameter of the nozzle 22, 134 is chosen so as to be no greater than the outside diameter of the conduit 20 to minimize the chance of the nozzle snagging on debris and the like in the clog. The inside diameter of the nozzle 22, 134, 186 is dimensioned to be smaller than the inside diameter of the conduit and is chosen to maximize the pressure of the stream. It will be appreciated by those skilled in the art that by varying the inside diameter of the nozzle relative to the inside diameter of the conduit the pressure of the stream will vary. However, dimensions of the inside of the nozzle should be balanced against the wall thickness of the conduit 20 which would have a maximum pressure that it could withstand. The length of the conduit 20, 130 will also impact on the pressure at the nozzle 22. That is, the longer the conduit, the lower the pressure at the tip. It has been found that for most applications preferably the conduit 20, 130 is no longer than 36 inches and where the conduit is sold with a water supply extension the conduit 20, 160 is preferably 18 inches but may be between 12 and 24 inches. The preferred dimensions for the plumbing trap flushing device conduit 20, 130 are an outside diameter of 0.250 inches and an insider diameter of the 0.187 inches. The nozzle 22 preferably has an outside diameter of 0.245 inches, an inside diameter of 0.125 inches and is 0.800 inches long. The nozzle 134 preferably has an inside diameter of 0.125 inches and is 0.800 inches long. Preferably the trap flushing device is approximately 36 inches long. However, if the plumbing trap flushing device 10, 120 is sold as part of kit in association with a water supply extension 70, 160 then the preferred length is between 12 and 24 and preferably 18 inches. Accordingly the conduit 20, 130 is between 12 and 36 inches long inclusive. The plumbing drain flushing device 80 preferably has an outside diameter of 0.375 inches and an inside diameter of 0.250 inch and a length of approximately 9 inches. The nozzle 62 for the drain flushing device 80 has an outside diameter of 0.310, an inside diameter of 0.155 and is 1.60 inches long. The plumbing drain flushing device 80 would typically be sold as part of a kit with the water supply extension 70. Preferably, the toilet flushing device 104 has an outside diameter of 0.375, an inside diameter of 0.250 and has a length of 18 but can be between 12 and 36 inches. The nozzle 106 has an outside diameter of 0.310 and an inside diameter of 0.155 inches and a length of 1.60 inches. Alternatively the toilet flushing device 104 has an outside diameter of 0.438 inches, an inside diameter 0.375 and a length of 24 inches. The nozzle 106 has an outside diameter of 0.435, and inside diameter of 0.155 and a length of 1.6 inches. Water supply extension 70 preferably has an outside diameter of 0.500 inches and an inside diameter of 0.375 inches and is approximately 15 feet in length. It will be appreciated by those skilled in the art that the outside diameter, inside diameter and length may change while still remaining within the scope of this invention. Preferably the conduits are made from polyethylene tubing, however EVA (Ethyl Vinyl Acetate), PVC (Polyvinyl Chloride), Nitrile, rubber, etc. could also be used.

It will be appreciated by those skilled in the art that the trap flushing device 10, universal connector 32, water supply extension 70, the drain flushing device 80 and the toilet flushing device 104 may be sold separately or as a kit.

Generally speaking, the systems described herein are directed to plumbing trap flushing devices. As required, embodiments of the present invention are disclosed herein. However, the disclosed embodiments are merely exemplary, and it should be understood that the invention may be embodied in many various and alternative forms. The Figures are not to scale and some features may be exaggerated or minimized to show details of particular elements while related elements may have been eliminated to prevent obscuring novel aspects. Therefore, specific structural and functional details disclosed herein are not to be interpreted as limiting but merely as a basis for the claims and as a representative basis for teaching one skilled in the art to variously employ the present invention. For purposes of teaching and not limitation, the illustrated embodiments are directed to plumbing trap flushing device.

As used herein, the term "comprises" and "comprising" are construed as being inclusive and opened rather than exclusive. Specifically, when used in this specification including the claims, the terms "comprises" and "comprising" and variations thereof mean that the specified features, steps or components are included. The terms are not to be interpreted to exclude the presence of other features, steps or components.

What is claimed as the invention is:

1. A plumbing trap flushing device for use with one of a drain in a sink, an overflow drain in a basin, a drain in a bathtub, an overflow drain in a bathtub, a drain in a shower, and for use with a tap, the tap having a spout and the spout having an aerator releasably connectable thereto, comprising:

a connector releasably and operably attachable to a spout of a tap, the connector having a conduit portion and a flange portion releasably connectable to the conduit portion and the flange portion being adapted to be held in place by an aerator connectable to the spout of the tap;

a conduit in flow communication with the connector and having an outside diameter and an inside diameter, the outside diameter being dimensioned to fit into the drain, whereby when the conduit is in the drain air and water freely flows around the conduit into the drain; and a nozzle in flow communication with a distal end of the conduit, the nozzle having an outside diameter no greater than the outside diameter of the conduit and the nozzle having a nozzle inside diameter less than the inside diameter of the conduit whereby water from the spout exits the nozzle under pressure in a stream.

2. The plumbing trap flushing device as claimed in claim 1 wherein the nozzle includes a nozzle adaptor and an interchangeable nozzle connected thereto.

3. The plumbing trap flushing device as claimed in claim 2 wherein the interchangeable nozzle has a central hole.

4. The plumbing trap flushing device as claimed in claim 2 wherein the interchangeable nozzle has a central hole and a plurality of side holes.

5. The plumbing trap flushing device as claimed in claim 4 wherein the side holes are angled and are adapted to shoot water at an angle sideways and backwardly.

6. The plumbing trap flushing device as claimed in claim 1 wherein the outside diameter of the conduit is 0.250 inches and the inside diameter is 0.187 inches.

7. The plumbing trap flushing device as claimed in claim 6 wherein the inside diameter of the nozzle is 0.125 inches.

8. The plumbing trap flushing device as claimed in claim 1 further including a water supply extension attachable to the connector of the plumbing trap flushing device at one end thereof and having an extension connector releasably attachable to the spout at the other end thereof.

9. The plumbing trap flushing device as claimed in claim 8 wherein the outside diameter of the water supply extension is 0.500 inches and the inside diameter is 0.375 inches.

10. The plumbing trap flushing device as claimed in claim 8 wherein the plumbing trap flushing device and the water supply extension are sold as a kit.

11. The plumbing trap flushing device as claimed in claim 10 wherein the kit further includes a drain flushing device having a conduit, a nozzle and a connector.

12. The plumbing trap flushing device as claimed in claim 11 wherein the outside diameter of the conduit of the drain flushing device is 0.375 inches and the inside diameter is 0.250 inches.

13. The plumbing trap flushing device as claimed in claim 11 wherein the inside diameter of the nozzle of the drain flushing device is 0.155 inches.

14. The plumbing trap flushing device as claimed in claim 11 wherein the drain flushing device is adapted to hook onto a drain strainer.

15. The plumbing trap flushing device as claimed in claim 10 wherein the kit further includes a toilet flushing device having a conduit, a nozzle and a connector.

16. The plumbing trap flushing device as claimed in claim 15 wherein the outside diameter of the conduit of the toilet flushing device is 0.375 inches and the inside diameter is 0.250 inches.

17. The plumbing trap flushing device as claimed in claim 15 wherein the outside diameter of the conduit of the toilet flushing device is 0.438 inches and the inside diameter is 0.375 inches.

18. The plumbing trap flushing device as claimed in claim 15 wherein the inside diameter of nozzle the toilet flushing device is 0.155 inches.

19. The plumbing trap flushing device as claimed in claim 1 wherein plumbing trap flushing device is used for cleaning a toilet.

20. The plumbing trap flushing device as claimed in claim 1 wherein the conduit of the plumbing trap flushing device is between 12 and 36 inches long inclusive.

21. The plumbing trap flushing device as claimed in claim 1 wherein the spout has an inside diameter and the inside diameter of the conduit is chosen to be less than the inside diameter of the spout and the inside diameter of the nozzle is chosen to be less than the inside diameter of the conduit.

22. The plumbing trap flushing device as claimed in claim 8 wherein the spout has an inside diameter and the inside diameter of the water supply extension is chosen to be equal to or less than the inside diameter of the spout, the inside diameter of the conduit is chosen to be less than the inside diameter of the water supply extension and the inside diameter of the nozzle is chosen to be less than the inside diameter of the conduit.

23. The plumbing trap flushing device as claimed in claim 11 wherein the spout has an inside diameter and the inside diameter of the water supply extension is chosen to be equal to or less than the inside diameter of the spout, the inside diameter of the conduit of the drain flushing device is chosen to be less than the inside diameter of the water supply extension and the inside diameter of the nozzle of the drain flushing device is chosen to be less than the inside diameter of the conduit.

24. The plumbing trap flushing device as claimed in claim 15 wherein the spout has an inside diameter and the inside diameter of the water supply extension is chosen to be equal to or less than the inside diameter of the spout, the inside diameter of the conduit of the toilet flushing device is chosen to be less than the inside diameter of the water supply extension and the inside diameter of the nozzle of the toilet flushing device is chosen to be less than the inside diameter of the conduit.

25. A plumbing trap flushing assembly for use with one of a drain in a sink, an overflow drain in a basin, a drain in a bathtub, an overflow drain in a bathtub, a drain in a shower and the like, the drain including a trap and a pipe connected to the trap, comprising:

a conduit in flow communication with a water source;

an activator operably connected to the water source for turning on and off the water source into the conduit;

a nozzle in flow communication with the conduit, the nozzle being positioned in the pipe upstream of the trap, the nozzle having an outside diameter no greater than the outside diameter of the conduit and the nozzle having a nozzle inside diameter less than the inside diameter of the conduit whereby water from the water source exits the nozzle under pressure in a stream and is directed towards the trap, the nozzle extends through the pipe generally at a right angle and downwardly with respect to the connector; and a nozzle connector between the conduit and the nozzle.

26. The plumbing trap flushing assembly as claimed in claim 25 wherein the activator is one of a push activator , a lever activator and a faucet handle activator.

27. The plumbing trap flushing assembly as claimed in claim 25 wherein the activator is positioned proximate to taps.

28. The plumbing trap flushing assembly as claimed in claim 25 wherein the activator is part of a faucet assembly.

29. The plumbing trap flushing assembly as claimed in claim 25 wherein the activator is separate from a faucet assembly.

30. The plumbing trap flushing assembly as claimed in claim 25 wherein the outside diameter of the conduit is 0.250 inches and the inside diameter is 0.187 inches.

31. The plumbing trap flushing assembly as claimed in claim 30 wherein the inside diameter of the nozzle of the drain flushing assembly is 0.125 inches.

* * * * *